United States Patent [19]

Mizukoshi

[11] Patent Number: 5,035,225

[45] Date of Patent: Jul. 30, 1991

[54] FUEL INJECTION CONTROL APPARATUS OF INTERNAL COMBUSTION ENGINE

[75] Inventor: Masashi Mizukoshi, Susono, Japan

[73] Assignee: Toyota Jidosha Kabushiki Kaisha, Toyota, Japan

[21] Appl. No.: 578,773

[22] Filed: Sep. 4, 1990

[30] Foreign Application Priority Data

Sep. 4, 1989 [JP] Japan ..... 1-228644
Dec. 18, 1989 [JP] Japan ..... 1-329070

[51] Int. Cl.[5] ..... F02M 51/00

[52] U.S. Cl. ..... 123/493; 123/492; 123/478

[58] Field of Search ..... 123/493, 492, 478, 480, 123/484; 364/431.05

[56] References Cited

U.S. PATENT DOCUMENTS

| | | | |
|---|---|---|---|
| 4,357,923 | 11/1982 | Hideg | 123/492 |
| 4,388,906 | 6/1983 | Sugiyama et al. | 123/492 |
| 4,454,847 | 6/1984 | Isomura et al. | 123/492 |
| 4,804,999 | 9/1989 | Fujisawa | 123/492 |
| 4,903,668 | 2/1990 | Chalt | 123/478 |
| 4,987,890 | 6/1991 | Nagaishi | 123/492 |

FOREIGN PATENT DOCUMENTS

| | | | |
|---|---|---|---|
| 59-7751 | 1/1984 | Japan | 123/492 |
| 59-196930 | 11/1984 | Japan | 123/492 |

*Primary Examiner*—Raymond A. Nelli

[57] ABSTRACT

A fuel injection control apparatus which controls the regular fuel injection amount based on a control law determined in accordance with a fuel dynamic model showing the dynamics of fuel flowing into an engine cylinder using as state variables the amount of fuel sticking to the walls of the intake passage and the amount of fuel evaporating in the intake passage.

During deceleration operation, the regular fuel injection is stopped, the control law correction fuel injection amount is determined from the parameter values of the fuel dynamic model, the true values of the rate of fuel sticking to the walls of the intake passage and the rate of remainder of sticking fuel, which are parameters of the fuel dynamic model, are identified based on the amount of fuel injection, the amount of air flowing into the cylinder, and the air-fuel ratio, and the control law is corrected based on the results of the identification.

25 Claims, 31 Drawing Sheets

FUEL SUPPLY STOP CONTROL PORTION
FUEL SUPPLY STOP JUDGEMENT PORTION
FUEL SUPPLY STOP EXECUTION PORTION
ENGINE
A/F
THA
PM
ω
THW
θ
B0
B1
B2
fi
FUEL EVAPORATION RATE CALCULATION PORTION
A1
STATE VARIABLE ESTIMATION PORTION
A7
ONE SAMPLING TIME SHIFTER
A8
fi(k-1)

| |
|---|
| Fig. 4A |
| Fig. 4B |
| Fig. 4C |

| Fig. 5A |
| --- |
| Fig. 5B |

| Fig. 6A |
| --- |
| Fig. 6B |

Pnow CALCULATION PROCESSING
700
CP = 0 ?
YES
NO
710
ΔPM>ΔPM1 ?
YES
NO
720
CP ← 1
1
730
ΔPM<ΔPM2 ?
YES
NO
740
WITHIN PREDETERMINED TIME AFTER Fλ SET ?
YES
NO
750
CP ← CP + 1

| Fig. 9A |
| --- |
| Fig. 9B |

| | |
|---|---|
| Fig. 10A | Fig. 10B |
| Fig. 10C | Fig. 10D |

FUEL INJECTION CONTROL APPARATUS OF INTERNAL COMBUSTION ENGINE

BACKGROUND OF THE INVENTION

1. Field of the Invention

The present invention relates to a fuel injection control apparatus of an internal combustion engine which controls the amount of fuel injection in accordance with control laws set based on a fuel dynamic model which describes the dynamics of fuel flowing into the cylinder of the internal combustion engine.

2. Description of the Related Art

In the past, there has been known, as an apparatus for controlling the amount of fuel injection so that the air-fuel ratio of the air-fuel mixture supplied to the internal combustion engine becomes a target air-fuel ratio, for example, the control apparatus based on the so-called linear control theory which, as described in Japanese Unexamined Patent Publication (Kokai) No. 59-196930, uses as control input a correction value for correcting a basic fuel injection amount found from the rotational speed and amount of intake air of the internal combustion engine and uses as control output the actual measured value of the air-fuel ratio detected using an air-fuel ratio sensor so as to identify that a linear approximation stands between the control input and control output, finds the mathematical model describing the dynamic characteristics of the internal combustion engine, and controls the fuel injection amount by control laws based on the same.

The relationship between the control input and the control output, however, is inherently nonlinear and it is only possible to describe the dynamic characteristics of an internal combustion engine under extremely narrow operating conditions, since the mathematical model is found using just linear approximation, as mentioned above. To achieve excellent control, it is necessary, as described in Japanese Unexamined Patent Publication (Kokai) No. 59-7751, to set a mathematical model for each of a plurality of operating regions where it is possible to deem that linear approximation stands and, based on this, to determine the control laws for each of the operating regions.

Therefore, in the above conventional apparatus, there has been the problem that it is necessary to change the control laws for each of the operating regions of the internal combustion engine, making the control complicated. Further, there was the problem of unstable control due to the switching of the control laws at the boundaries of the operating regions.

To resolve this problem, proposal was made of a fuel injection control apparatus which could execute fuel injection control without switching control laws as mentioned above by determining nonlinear compensation control laws based on a fuel dynamic model describing the dynamics of the fuel in the internal combustion engine (that is, using a single set of control laws) (see U.S. Pat. No. 4,903,668).

However, it is difficult to accurately describe at all times the dynamics of fuel in an internal combustion engine even with the above-mentioned fuel dynamics. In actuality, the fuel dynamic model loses its correspondence with the actual fuel dynamics due to changes in the engine characteristics along with time and if the control laws of the time of setting are used as they are for execution of fuel injection control, it sometimes becomes impossible to ensure the control accuracy of the air-fuel ratio. In particular, when the internal combustion engine is operated for a long period, deposits form on the walls of the intake pipe, whereby the model parameter expressing the proportion of the fuel sticking to the wall of the intake pipe in the above-mentioned fuel dynamic model becomes different from reality and as a result the control accuracy of the air-fuel ratio ends up reduced.

To resolve this problem, it has been considered to calculate the model parameter based on the amount of fuel supplied by injection to the internal combustion engine, the amount of air flowing into the cylinders, and the air-fuel ratio detected based on the components of the exhaust of the internal combustion engine and to correct the control laws based on the results of the calculation. The proposed apparatus finds the time intervals of the change of the air-fuel ratio from lean to rich or rich to lean based on the above-mentioned amount of fuel, amount of air, and air-fuel ratio and estimates the model parameter based on this time interval so as to enable correction of the control error along with changes in the above model parameter. According to this apparatus, automatic control is performed so as to make the control laws correspond to the actual fuel dynamics, making it possible to improve the control accuracy of the air-fuel ratio.

Examining this apparatus in more detail, if the fuel injected into the internal combustion engine changes in fuel properties to something different from the time of design, an error occurs with respect to the estimated value of the model parameter and it becomes impossible to correct the control laws well, it was learned.

That is, first, when the characteristics of the fuel injected into the internal combustion engine change, there is a change not only in the proportion of the injected fuel sticking to the walls of the intake pipes, but also the amount of the fuel sticking to the walls of the intake pipe directly flowing into the cylinder. Therefore, the time interval from the change of the air-fuel ratio, calculated based on the amount of fuel amount of air, and air-fuel ratio, from lean to rich or rich to lean changes according also to the amount of change of the amount of fuel sticking to the walls of the intake pipe flowing directly into the cylinder due to the changes in the characteristics of the fuel injected. If, as mentioned above, the model parameter expressing the proportion of injected fuel sticking to the walls of the intake pipe is continuously calculated, the model parameter will be erroneously estimated and it will end up impossible to correct the control laws well.

SUMMARY OF THE INVENTION

The object of the present invention is to provide a fuel injection control apparatus which can make the air-fuel ratio accurately coincide with a predetermined air-fuel ratio based on control laws determined in accordance with a fuel dynamic model.

According to the present invention, there is provided a fuel injection control apparatus of an internal combustion engine having an intake passage, comprising: a fuel injector for injecting fuel in the intake passage; fuel injection amount calculation means for calculating the regular fuel injection amount to be injected from the fuel injector based on a control law determined in accordance with a fuel dynamic model expressing the dynamics of the fuel flowing into a cylinder of the engine; fuel injection stopping means for stopping the regular fuel injection based on the calculation by the fuel injection amount calculation means; control law correction fuel injection means for performing control law correction injection during the stoppage of the regular fuel injection; fuel sticking rate calculation means for calculating the rate of sticking of the control law correction injected fuel to the walls of the intake passage based on the amount of control law correction fuel injected during the stoppage of the regular fuel injection, amount of air flowing into the cylinder, and the air-fuel ratio of the air-fuel mixture flowing into the cylinder; and correction means for correcting the control law with respect to the amount of injected fuel to be supplied to the engine and making the air-fuel ratio a predetermined air-fuel ratio based on the calculated rate of sticking of fuel.

The present invention will be more fully understood from the description of the preferred embodiments of the invention set forth below, together with the accompanying drawings.

DESCRIPTION OF THE PREFERRED EMBODIMENTS

Figure 1:
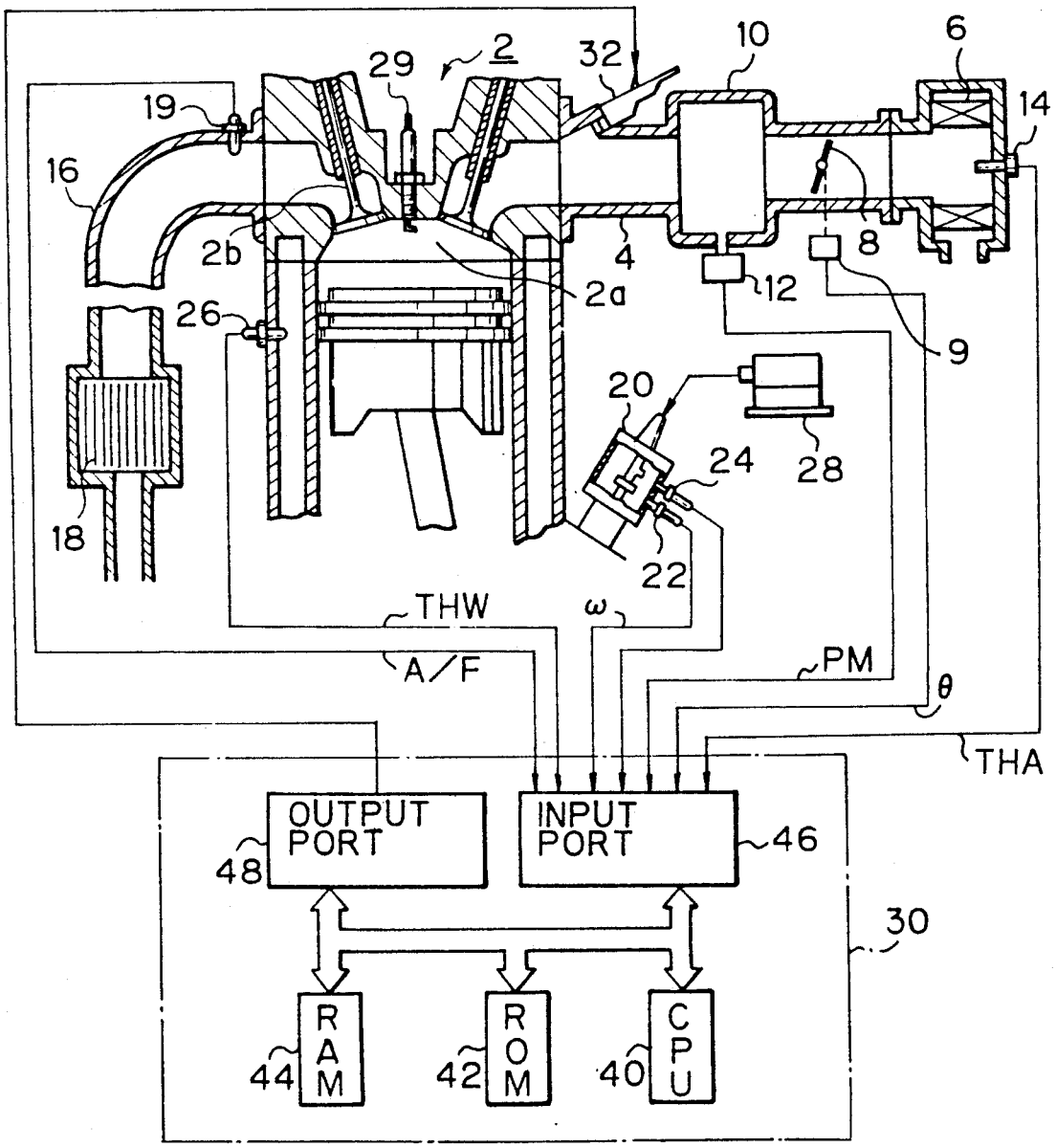
FIG. 1 is a schematic constitutional view showing an internal combustion engine and peripheral equipment of an embodiment.

First, FIG. 1 is a schematic constitutional view showing an internal combustion engine 2 and peripheral equipment to which the present invention is applied.

As illustrated, at an intake pipe 4 of the internal combustion engine 2 there are provided an air cleaner 6 for cleaning the intake air, a throttle valve 8 for controlling the amount of the intake air, a throttle opening sensor 9 for detecting the opening (throttle opening) of a throttle valve 8, a surge tank 10 for suppressing pulsation of the intake, an intake pressure sensor 12 for detecting the pressure inside the surge tank 10 (intake pipe pressure) PM, and an intake temperature sensor 14 for detecting the intake temperature THA. At the exhaust pipe 16 there are provided a three-way catalytic converter 18 for cleaning the exhaust and an air-fuel ratio sensor 19 for detecting if the air-fuel ratio (A/F) of the air-fuel mixture supplied to the internal combustion engine 2 is lean or rich compared with the stoichiometric air-fuel ratio.

Further, at the internal combustion engine 2 there are provided, in addition to the above-mentioned throttle opening sensor 9, intake pressure sensor 12, intake temperature sensor 14, and air-fuel ratio sensor 19, as sensors for detecting the operating state, a rotational speed sensor 22 for detecting the rotational speed $\omega$ of the internal combustion engine 2 from the rotation of the distributor 20, a crank angle sensor 24 for detecting the timing of the fuel injection to the internal combustion engine 2 from the rotation of the distributor 20, and a water temperature sensor 26 for detecting the coolant water temperature THW of the internal combustion engine 2. Further, the distributor 20 is for applying a high voltage from an ignitor 28 to a spark plug 29 at a predetermined ignition timing and rotates in synchronization with the rotation of an internal combustion engine 2.

Next, the detection signals from the sensors are input to an electronic control circuit 30, which is comprised as a logical calculation circuit built around a microcomputer, drive a fuel injector 32, and control the amount of fuel injection from the fuel injector 32.

The electronic control circuit 30 includes a CPU 40 for executing calculation processing for controlling the amount of fuel injection in accordance with a preset control program, a ROM 42 in which the control programs and in initialization data required for execution of the calculation processing by the CPU 40 are stored in advance, a RAM 44 in which data used for execution of calculation processing by the CPU 40 is written in temporarily, an input port 46 for inputting detection signals from the above sensors, and an output port 48 for outputting drive signals to the fuel injector 32 in accordance with the results of calculation of the CPU 40. It controls the amount of fuel from the fuel injector 32 so that the air-fuel ratio of the air-fuel mixture flowing into the cylinder 2*a* of the internal combustion engine 2 becomes the preset target air-fuel ratio.

Next, the control law for the control of the amount of fuel injection executed by the electronic control circuit 30 will be explained based on the block diagram of FIG. 2.

Figures 2, 2A, 2B, 2C, 2D:
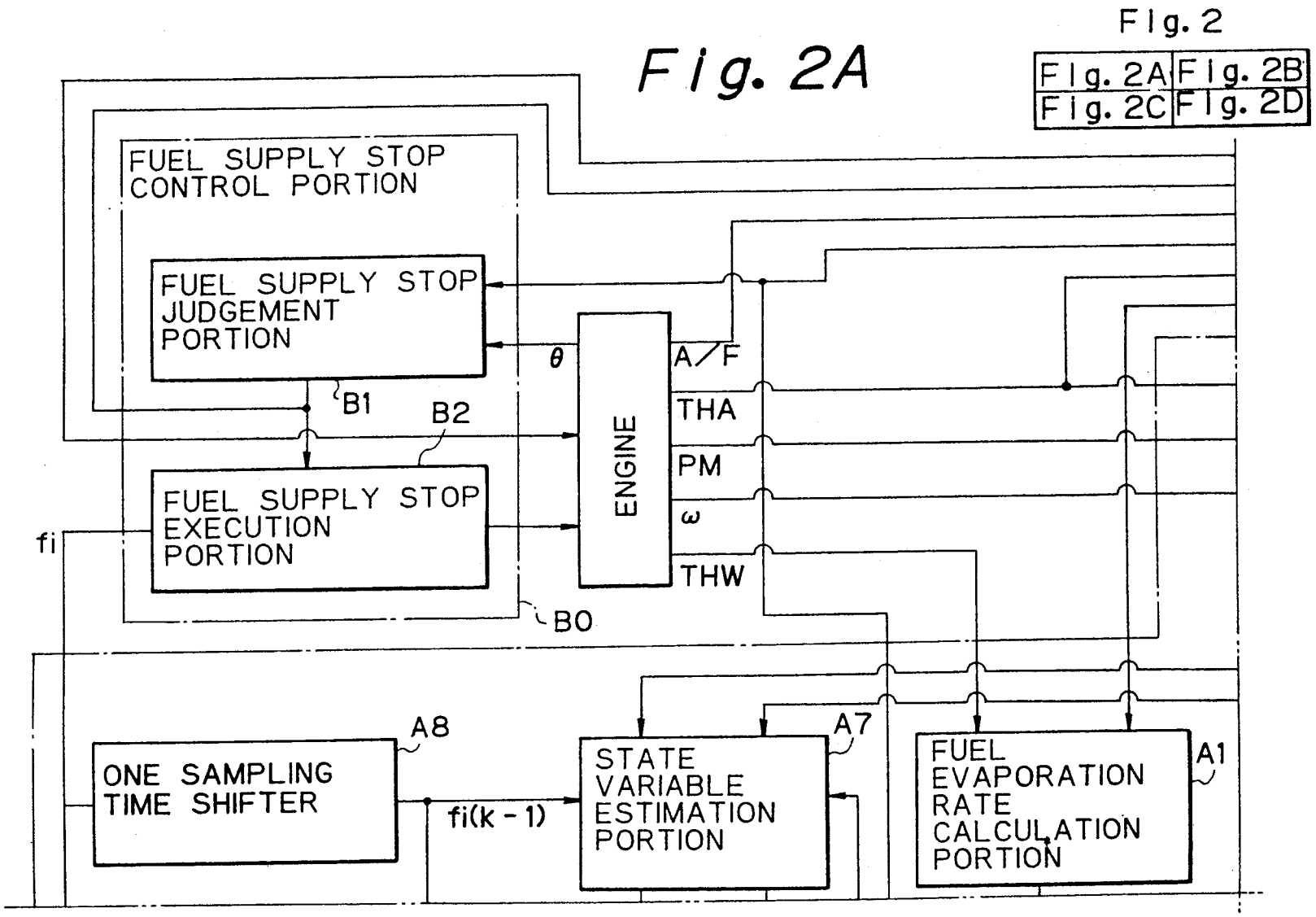
FIG. 2 is a block diagram showing a control law for controlling the fuel injection by an electronic control circuit.
Figure 2B:
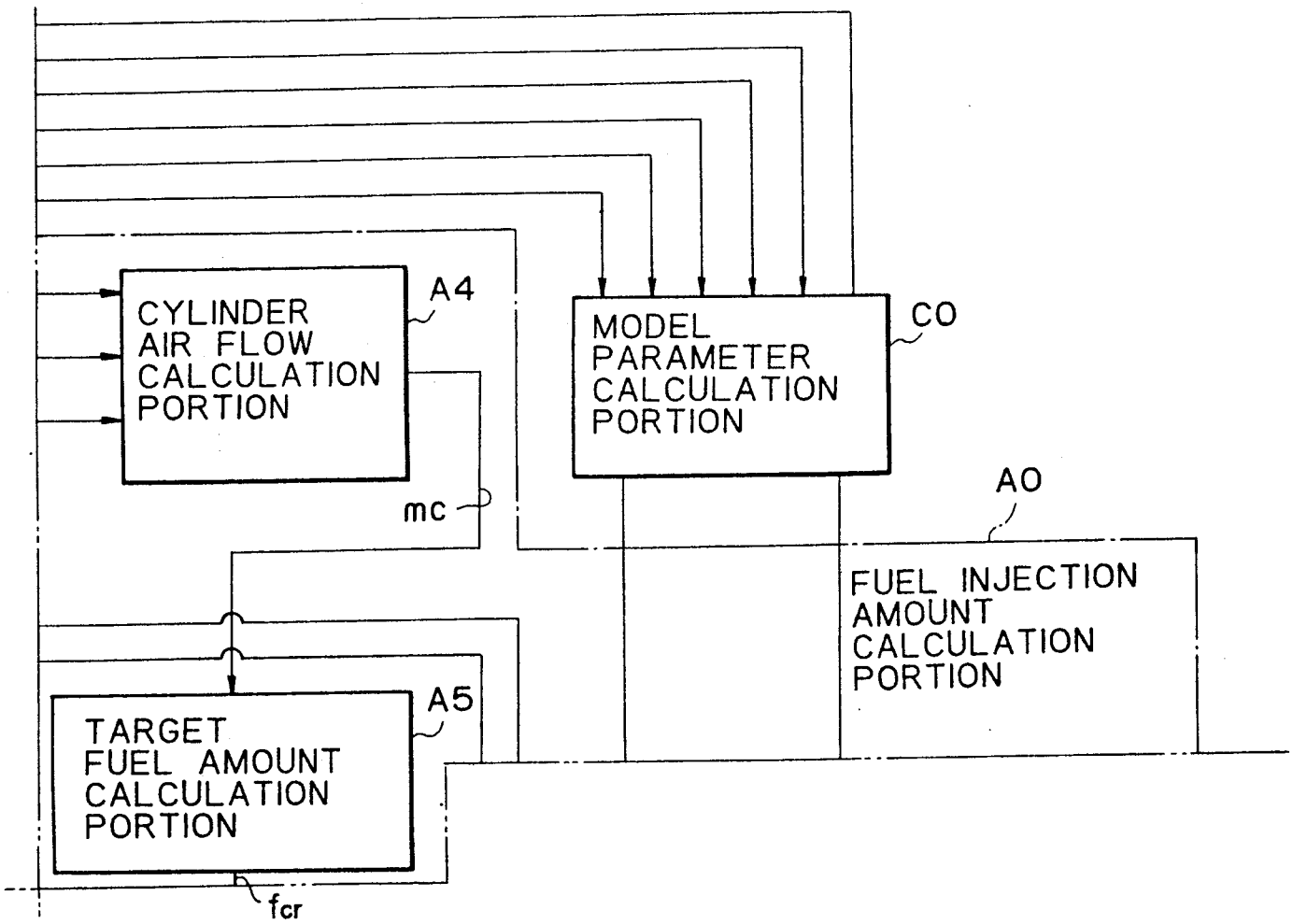
Figure 2C:
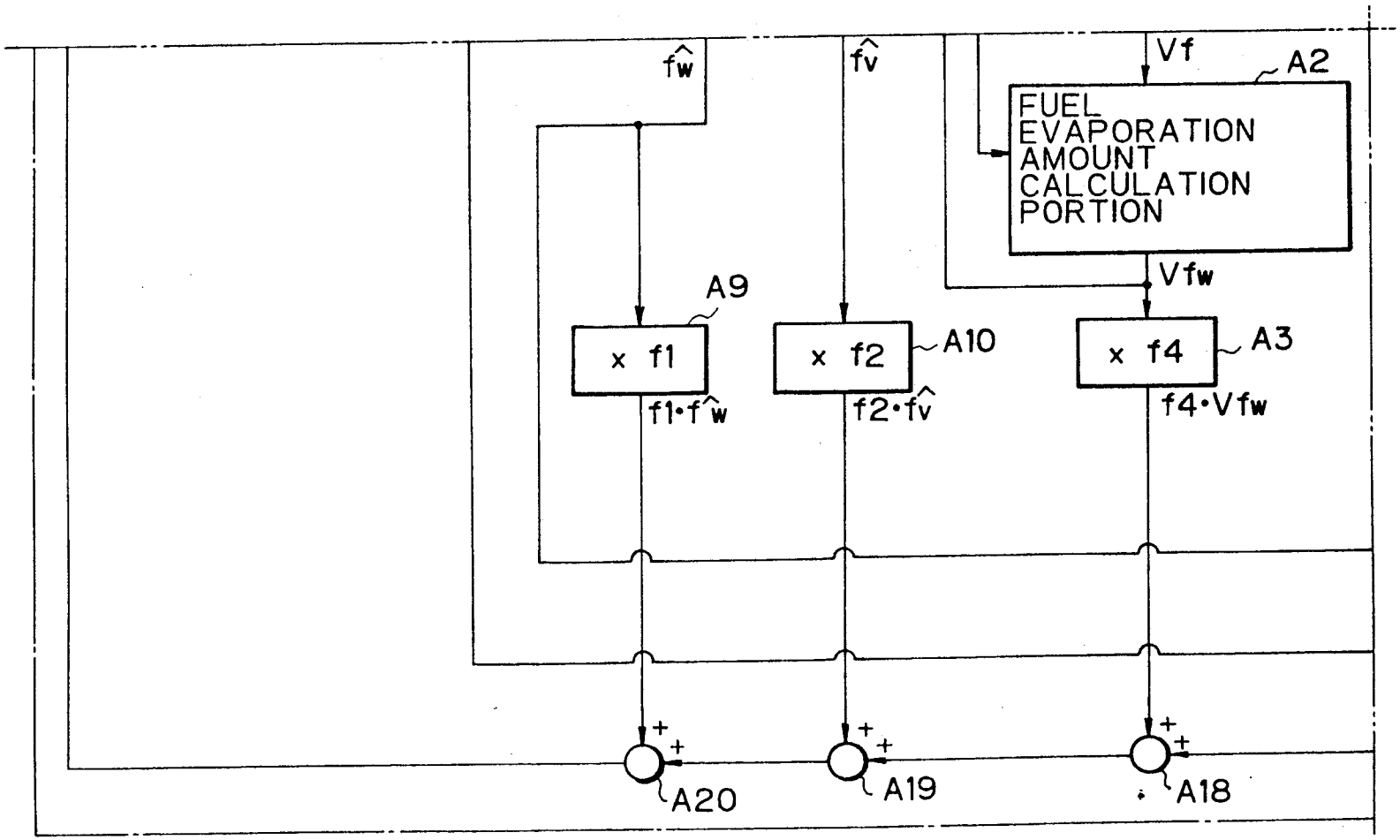
Figure 2D:
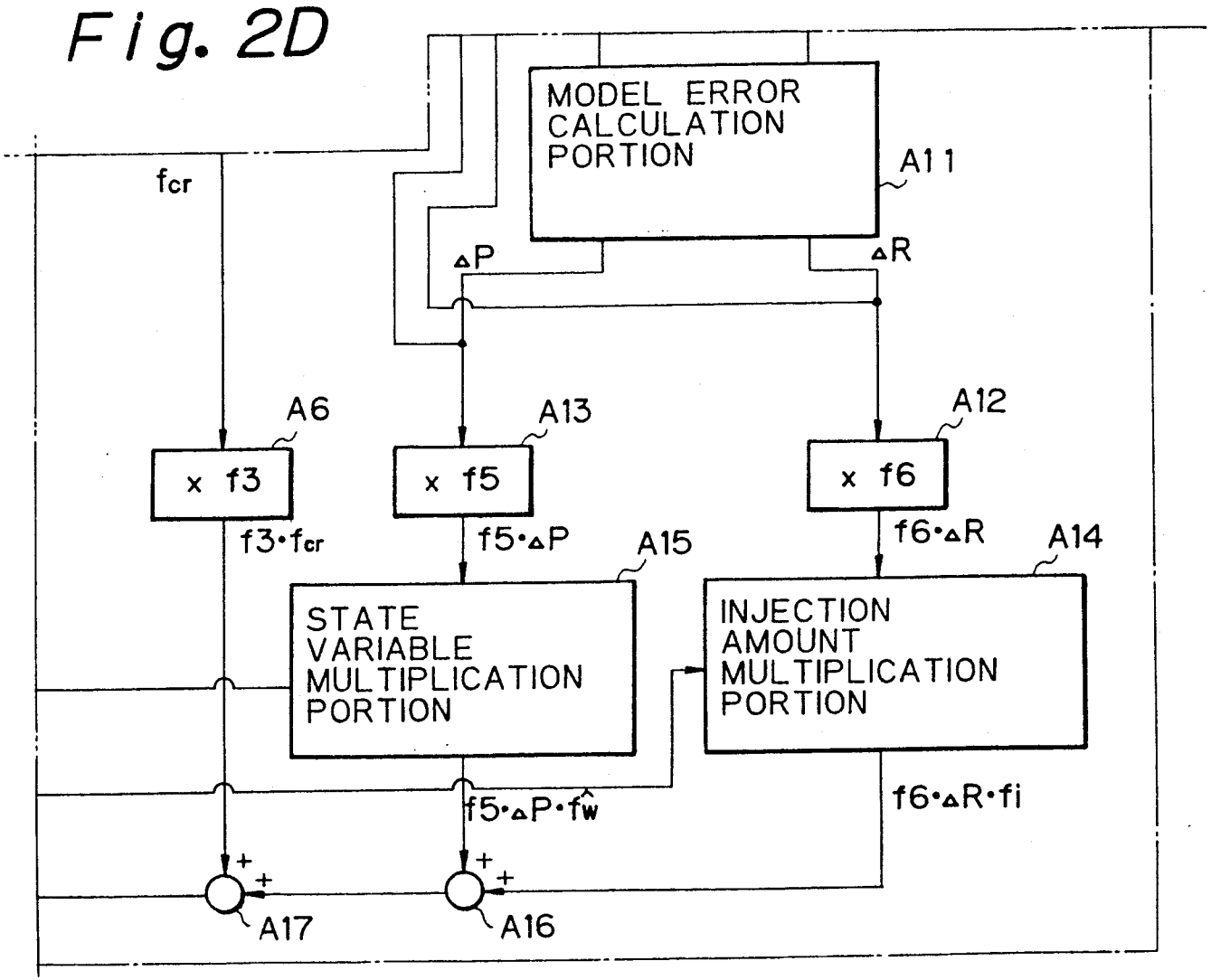

FIG. 2 is a block diagram showing control law of an embodiment. This does not show the hardware construction. The actual control is realized by execution of a series of control programs shown in the flow chart of FIG. 5 to FIG. 12.

Further, the control law is designed based on the fuel dynamic model shown in the following equations (1) and (2) describing the dynamics of the fuel flowing into the cylinder 2a of the internal combustion engine 2:

$$\begin{bmatrix} \hat{fw}(k+1) \\ \hat{fv}(k+1) \end{bmatrix} = \begin{bmatrix} PO \\ OQ \end{bmatrix} \cdot \begin{bmatrix} \hat{fw}(k) \\ \hat{fv}(k) \end{bmatrix} + \begin{bmatrix} R \\ S \end{bmatrix} \cdot fi(k) + \begin{bmatrix} -D \\ +D \end{bmatrix} \cdot Vfw(k) \quad (1)$$

$$fc(k) = [1 - P1 - Q] \begin{bmatrix} \hat{fw}(k) \\ \hat{fv}(k) \end{bmatrix} + (1 - R - S)fi(k) - \Delta P \cdot \hat{fw}(k) - \Delta R \cdot fi(k) \quad (2)$$

(where, $\hat{fw}$ is the amount of fuel sticking to the walls of the intake pipe, $\hat{fv}$ is the amount of fuel vaporizing in the intake pipe, fi is the amount of fuel injected, Vfw is the amount of fuel evaporating from the walls of the intake pipe, fc is the amount of fuel flowing into the cylinder, and P, Q, R, S, and D are constants).

As shown in FIG. 2, the control law of the embodiment includes a fuel injection amount calculation portion A0 which calculates the amount of fuel injection fi to the internal combustion engine 2 using a preset calculation equation based on the above mentioned fuel dynamic model, a fuel supply stop control portion B0 which prohibits the supply of fuel to the internal combustion engine 2 under predetermined operating conditions of the internal combustion engine 2, and a model parameter calculation portion CO which supplies fuel to the internal combustion engine 2 during operation of the fuel supply stop control portion B0, calculates the true value $R_{CR}$ of the model parameter R of the above mentioned fuel dynamic model from the state of the air-fuel ratio at that time, learns and updates the model parameter P of the above-mentioned fuel dynamic model based on the air-fuel ratio at the time of acceleration of the internal combustion engine 2, calculates the learned value $P_{NOW}$ as the true value of the model parameter, or calculates the true value $P_{CR}$ of the model parameter.

Here, in the fuel injection amount calculation portion A0, first the intake pipe pressure PM detected by the intake pressure sensor 12 and the coolant water temperature THW detected by the water temperature sensor 26 are input to the fuel evaporation rate calculation portion A1. The fuel evaporation rate calculation portion A1 calculates the amount Vf of fuel evaporation per unit time from the walls of the intake pipe (fuel evaporation rate). It finds the saturation evaporation pressure Ps in the intake pipe 4 from the coolant water temperature THW and calculates the fuel evaporation rate Vf from the saturation evaporation pressure Ps and the intake pipe pressure PM.

That is, the fuel evaporation rate Vf from the walls of the intake pipe may be found as a function of the saturation pressure Ps of the fuel in the intake pipe 4 and the pressure inside the intake pipe 4 (intake pipe pressure) PM. Further, the saturation pressure Ps is a function of the temperature Tq of the fuel sticking to the walls of the intake pipe. This sticking fuel temperature Tq may be represented by the coolant water temperature THW of the internal combustion engine 2 or the temperature of the cylinder head near the intake port, so in the embodiment, first the saturation pressure Ps is found using the following equation (3) having as a parameter the coolant water temperature THK (°K.):

$$Ps = \beta 1 \cdot THW^2 - \beta 2 \cdot THW + \beta 3 \quad (3)$$

(where, $\beta 1$, $\beta 2$, and $\ominus 3$ are constants)

After this, the fuel evaporation rate Vf is calculated from the thus calculated saturation pressure Ps and the intake pipe pressure PM.

The fuel evaporation rate Vf calculated by the fuel evaporation rate calculation portion A1 is input to a fuel evaporation amount calculation portion A2. The fuel evaporation amount calculation portion A2 calculates the amount of fuel Vfw ($=Vf/\omega$) evaporating from the walls of the intake pipe per revolution of the internal combustion engine 2 by dividing the fuel evaporation rate Vf by the rotational speed $\omega$ of the internal combustion engine 2 detected using the rotational speed sensor 22. The result of the calculation Vfw is input to a coefficient f4 multiplication portion A3 where it is multiplied by a preset coefficient f4.

Further, the intake pipe pressure PM and rotational speed $\omega$ are input together with the intake temperature THA detected by the intake temperature sensor 14 into a cylinder air flow calculation portion A4. The cylinder air flow calculation portion A4 calculates the amount of air mc flowing into the cylinder 2a at the time of an intake stroke of the internal combustion engine 2 using the following equation (4):

$$mc = \{\beta x(\omega) \cdot PM - \beta y(\omega)\}/THA \quad (4)$$

(where, $\beta x(\omega)$ and $\beta y(\omega)$ are function of the rotational speed $\omega$) based on the input intake pipe pressure PM, rotational speed $\omega$, and intake temperature THA. The result of the calculation mc is input to a target fuel amount calculation portion A5. At the target fuel amount calculation portion A5, the calculated amount of air mc and a preset target air-fuel ratio (inverse of target air-fuel ratio) $\lambda r$ are multiplied to calculate the amount of fuel fcr (that is, the target fuel amount) to flow into the cylinder 2a. This target fuel amount fcr is input to a coefficient f3 multiplication portion A6 where it is multiplied with a preset coefficient f3.

On the other hand, the amount of fuel evaporated Vfw calculated by the above-mentioned fuel evaporation amount calculation portion A2 is input to a state variable estimation portion A7, which state variable estimation portion A7 uses preset calculation equations and estimates the state variables fw and fv for multiplication of the next fuel injection amount fi(k) from the above-mentioned input fuel evaporation amount Vfw, the previously calculated fuel injection amount fi(k−1) input through a one sampling time shifter, the errors $\Delta P$ and $\Delta R$ of the model parameters P and R calculated by the later-mentioned model error calculation portion A11, and the state variable amount $\hat{fw}(k-1)$ and fv(k−1) estimated previously by the state variable estimation portion A7. The results of the estimation $\hat{fw}$ and fv are multiplied by the coefficients f1 and f2, respectively, at a coefficient f1 multiplication portion and a coefficient f2 multiplication portion A10.

Next, a model error calculation portion A11 calculates the true value of the model parameter R and the learned value $P_{NOW}$ or true value $P_{CR}$ of the model parameter calculated at the model parameter calculation portion CO and the error with the model parameters R and P of the fuel dynamic model used at the time of the design of the fuel injection amount calculation portion A0 as the errors ΔR and ΔP of the model parameters R and P. The results of the calculation ΔR and ΔP are output to not only the above-mentioned state variable estimation portion A7, but also a coefficient f6 multiplication portion A12 and coefficient f5 multiplication portion A13, at which coefficient multiplication portions A12 and A13 they are multiplied by the coefficients f6 and f5. Further, the results of multiplication f6·ΔR and f5·ΔP are respectively output to the injection amount multiplication portion A14 and state variable multiplication portion A15, at which portions A14 and A15 they are multiplied by the state variable $\hat{f}w$ estimated by the state variable estimation portion A7 and the fuel injection amount fi(k−1) previously calculated and input through the one sampling time shifter A8.

The results of multiplication by the injection amount multiplication portion A14 and the state variable multiplication portion A15 are added at the addition portions A16 to A20 with the results of multiplication of the coefficient multiplication portions A3, A6, A9, and A10, whereby the fuel injection amount fi is calculated.

The fuel injection amount fi for controlling the air-fuel ratio to the target air-fuel ratio is calculated at the fuel injection amount calculation portion A0 in this way. Next, an explanation will be given on the derivation of the above-mentioned fuel dynamic model serving as the basis for the fuel injection amount calculation portion A0 and the procedure for design of the fuel injection amount calculation portion A0 based on this fuel dynamic model.

First, the amount of fuel fc flowing into the cylinder 2*a* of the internal combustion engine 2 may be described as in the following equation (5) using the fuel injection amount fi, from the fuel injector 32, the amount of $\hat{f}w$ sticking to the walls of the intake pipe, and the amount of fuel evaporated fv in the intake pipe 4:

$$fc=\alpha 1\cdot fi+\alpha 2\cdot \hat{f}w+\alpha 3\cdot \hat{f}v \tag{5}$$

That is, the above-mentioned amount of fuel fc may be considered to be the sum of the amount of injected fuel directly flowing from the fuel injector 32, that is, α1·fi, the amount of injected fuel indirectly flowing from the intake pipe 4 where it is stuck, that is, α2·$\hat{f}w$ and the amount of the evaporated fuel present at the inside of the intake pipe 4 due to evaporation of the injected fuel or fuel sticking to the walls, so it is possible to describe the amount of fuel fc flowing into the cylinder 2*a* as in above equation (5).

In equation (5), the fuel injection amount fi is determined by the opening time of the fuel injector 32, so if the amount of fuel fw sticking to the walls of the intake pipe and the amount of fuel $\hat{f}v$ evaporating in the intake pipe 4 can be determined, it is possible to predict the amount of fuel fc.

Therefore, next consideration will be given to the above-mentioned amount of sticking fuel $\hat{f}w$ and the amount of evaporated fuel $\hat{f}v$.

First, the amount of fuel fw sticking to the walls of the intake pipe decreases by a part α2 with each intake stroke due to the inflow into the cylinder 2*a* at the time of the intake stroke and, further, decreases due to evaporation into the inside of the intake pipe 4. It increases by sticking of a part α4 of the fuel injection amount fi injected from the fuel injector 32 in synchronization with the intake cycle. Further, the amount of fuel evaporation with each intake cycle may be expressed as α5·Vf/ω (=α5·Vfw, 60 5: proportional constant) from the amount of fuel evaporation per unit time (that is, the fuel evaporation rate) Vf and the rotational speed ω of the internal combustion engine 2. Therefore, the amount of fuel $\hat{f}w$ sticking to the walls of the intake pipe may be described as shown in the following equation (6):

$$\hat{f}w(k+1)=(1-\alpha 2)\cdot \hat{f}w(k)+\alpha 4\cdot fi(k)-\alpha 5\cdot Vfw(k) \tag{6}$$

(where, k is the intake cycle)

On the other hand, the amount of evaporated fuel $\hat{f}v$ in the intake pipe 4 decreases by a part α3 with each intake cycle due to the inflow into the cylinder 2*a* during an intake stroke and, further, increases due to evaporation of a part α6 of the fuel injection amount fi and, further, increases due to evaporation of the above sticking fuel. Therefore, the amount of evaporated fuel $\hat{f}v$ in the intake pipe 4 may be described as shown by the following equation (7):

$$\hat{f}v(k+1)=(1-\alpha 3)\cdot \hat{f}v(k)+\alpha 6\cdot fi(k)+\alpha 5\cdot Vfw(k) \tag{7}$$

Therefore, in the above equations (5) to (7), it is possible to arrange (1−α2) as P, (1−α3) as Q, α4 as R, α6 as S, and α5 as D and thereby obtain the aforementioned equations (1) and (2) showing the fuel dynamics in the internal combustion engine 2 using as state variables the amount of fuel $\hat{f}w$ sticking to the walls of the intake pipe and the amount of fuel $\hat{f}v$ evaporated in the intake pipe 4. This determines a fuel dynamic model expressed by a discrete time system using as the sampling period the intake cycle of the internal combustion engine 2.

In such a fuel dynamic model, nonlinear compensation is performed by the clause Vfw, so if the model parameters P, Q, R, S, and D are set by a known identification method, it is possible to accurately describe the fuel dynamics of the internal combustion engine 2 in the entire operating region of the internal combustion engine 2. However, the characteristics of an internal combustion engine 2 change along with time, so sometimes the fuel dynamics of an internal combustion engine 2 can no longer be accurately described by a specific fuel dynamic model.

Therefore, in this embodiment, to compensate for the control error occurring due to changes or variations in characteristics of the internal combustion engine 2, the fuel dynamic model described by the above equations (1) and (2) are modified as shown by the following equations (8) and (9) and the fuel injection amount calculation portion A0 is determined based on the thus modified fuel dynamic model:

$$\begin{bmatrix}\hat{f}w(k+1)\\ \hat{f}v(k+1)\end{bmatrix}=\begin{bmatrix}PO\\ OQ\end{bmatrix}\cdot\begin{bmatrix}\hat{f}w(k)\\ \hat{f}v(k)\end{bmatrix}+\begin{bmatrix}R\\ S\end{bmatrix}\cdot fi(1k)+\begin{bmatrix}-D\\ +D\end{bmatrix}\cdot Vfw(k)+\begin{bmatrix}\Delta P\\ O\end{bmatrix}\cdot \hat{f}w(k)+\begin{bmatrix}\Delta R\\ O\end{bmatrix}\cdot fi(k) \tag{8}$$

$$fc(k)=[1-P1-Q]\begin{bmatrix}\hat{f}w(k)\\ \hat{f}v(k)\end{bmatrix}+(1-R-S)fi(k)-\Delta P\cdot \hat{f}w(k)-\Delta P\cdot \hat{f}w(k)-\Delta R\cdot fi(k) \tag{9}$$

That is, in the fuel dynamic model described by the equations (1) and (2), the amount of evaporated fuel $\hat{fv}$ and the amount of fuel evaporation Vfw are much smaller than the amount of fuel $\hat{fw}$ sticking to the walls and the amount of fuel injection fi and even if there are fluctuations in the model parameters R, S, and D, there is almost no effect on the control accuracy, so in this embodiment, the errors ΔP and ΔR of the parameters P and R, which have a major effect on the control accuracy, are added to the fuel dynamic model described by the equations (1) and (2) so as to set a fuel dynamic model of the equations (8) and (9). By designing the fuel injection amount calculation portion A0 based on this fuel dynamic model, the model errors ΔP and ΔR calculated by the model error calculation portion A11 are used to correct the control law of the fuel injection amount calculation portion A0 and compensate for the control accuracy of the fuel injection amount.

Next, an explanation will be made of the procedure for design of the fuel injection amount calculation portion A0 based on a fuel dynamic model described by the above-mentioned equations (8) and (9):

The above-mentioned fuel dynamic model is nonlinear, so to apply linear control theory, the fuel dynamic model is linearly approximated. In the above-mentioned equations (8) and (9), if $$x(k) = [\hat{fw}(k)\hat{fv}(k)]^T \tag{10}$$

$$A = \begin{bmatrix} PO \\ OQ \end{bmatrix} \tag{11}$$

$$B = \begin{bmatrix} R \\ S \end{bmatrix} \tag{12}$$

$$w = [-D \cdot Vfw(k) + \Delta P \cdot \hat{fw}(k) + \Delta R \cdot fi(k) + D \cdot Vfw(k)] \tag{13}$$

$$y(k) = fc(k) - (1 - R - S)fi(k) + \Delta P \cdot \hat{fw}(k) + \Delta R \cdot fi(k) \tag{14}$$

$$u(k) = fi(k) \tag{15}$$

$$C = [131\ P\ 1 - Q] \tag{16}$$

then the above-mentioned equations (8) and (9) may be expressed as:

$$x(K+1) = A \cdot x(k) + B \cdot u(k) + w(k) \tag{17}$$

$$y(k) = C \cdot x(k) \tag{18}$$

Here, when the steady state is reached with y(k)=yr (set point), if u(k)=ur and x(k)=xr, then the above equations (17) and (18) become as shown by the following equations (19) and (20):

$$xr = A \cdot xr + B \cdot ur + w(k) \tag{19}$$

$$yr = C \cdot xr \tag{20}$$

From the above equations (17) to (20), $$x(k+1) - xr = A(x(k) - xr) + B(u(k) - ur) \tag{21}$$

$$y(k) - yr = C(x(k) - xr) \tag{22}$$

Next, in the above equations (21) and (22), if $$X(k) = x(k) - xr \tag{23}$$

$$U(k) = u(k) - ur \tag{24}$$

$$Y(k) = y(k) - yr \tag{25}$$

then equations (21) and (22) become the following equations (26) and (27):

$$X(k+1) = AX(k) + BU(k) \tag{26}$$

$$Y(k) = CX(k) \tag{27}$$

In equations (26) and (27), if X(k)→0, then Y(k)=0 and if u(k)→ur, then y(k)→yr. Therefore, it is sufficient to design the optimum regulator of the above equation (26). That is, by solving the discrete type Riccati equation, the optimal control is found by the following equation (28):

$$U(k) = FX(k) \tag{28}$$

Further, this equation (28) becomes the following equation (29) by the above equations (23) and (24):

$$u(k) = F \cdot xr + ur \tag{29}$$

Therefore, in the above equations (19) and (20), $$\begin{bmatrix} I - A & -B \\ C & O \end{bmatrix} \begin{bmatrix} xr \\ ur \end{bmatrix} = \begin{bmatrix} w(k) \\ yr \end{bmatrix} \tag{30}$$

Solving this for xr and ur, the equation (29) is finalized and it is possible to find u(k).

In the case of this embodiment, the above equation (30) becomes the following equation (31) by the above equations (10) to (16):

$$\begin{bmatrix} 1 - P & O & -R \\ O & 1 - Q & -S \\ 1 - O & 1 - Q & O \end{bmatrix} \begin{bmatrix} fwr \\ fvr \\ fir \end{bmatrix} = \begin{bmatrix} -D \cdot Vfw(k) + \Delta P \cdot \hat{fw}(k) + \Delta R \cdot fi(k) + D \cdot Vfw(k) \\ fcr(k) - (1 - R - S)fi(k) + \Delta P \cdot \hat{fw}(k) + \Delta R \cdot fi(k) \end{bmatrix} \tag{31}$$

xr, ur (that is, fwr, fvr, and fir) are respectively determined by the following equations (32) to (34):

$$fwr = \beta 11 \cdot Vfw(k) + \beta 12\{fcr(k) - (1 - R - S) \cdot fi(k)\} + \beta 13\{\Delta P \cdot \hat{fw}(k) + \Delta R \cdot fi(k)\} \tag{32}$$

$$fvr = \beta 21 \cdot Vfw(k) + \beta 22\{fcr(k) - (1 - R - S) \cdot fi(k)\} + \beta 23\{\Delta P \cdot \hat{fw}(k) + \Delta R \cdot fi(k)\} \tag{33}$$

$$fir = \beta 31 \cdot Vfw(k) + \beta 32\{fcr(k) - (1 - R - S) \cdot fi(k)\} + \beta 33\{\Delta P \cdot \hat{fw}(k) + \Delta R \cdot fi(k)\} \tag{34}$$

(where, β11 to β33 are constants)

Therefore, by substituting the equations (32), (33), and (34) into the above equation (29), the calculation equation for finding the control input u(k), that is, the fuel injection amount fi(k), becomes as follows:

$$fi(k+1) = f1 \cdot fw(k) + f2 \cdot fv(k) + f3 \cdot fcr(k) + f4 \cdot \tag{35}$$

-continued $$Vfw(k) + f5 \cdot \Delta P \cdot fw(k) + f6 \cdot \Delta R \cdot fi(k)$$

Further, equation (35) describes the parts for calculating the fuel injection amount fi in the fuel injection amount calculation portion, that is, the various multiplication portions A3, A6, A9, A10, and A12 to A15 and the addition portions A16 to A20. Further, the state variables in equation (35), that is, the amount of sticking fuel $\hat{fw}$ and the amount of evaporated fuel $\hat{fv}$, are calculated in the state variable estimation portion A7, but the state variable estimation portion A7 uses the state equation (8) as is to calculate the state variables $\hat{fw}$ and $\hat{fv}$.

Next, in the fuel supply stop control portion B0, first, the rotational speed $\omega$ of the internal combustion engine 2 detected by the rotational speed sensor 22 and the throttle opening $\theta$ detected by the throttle opening sensor 9 are input to a fuel supply stop judgement portion B1. The fuel supply stop judgement portion B1 judges if the conditions stand for execution of the fuel supply stop control, where the internal combustion engine 2 is operated above a predetermined rotational speed when the throttle valve 8 is fully opened based on the input data 107 and $\theta$. If it is judged by the fuel supply stop judgement portion B1 that the conditions stand for execution of the fuel supply stop control, then a fuel supply stop execution portion B2 operates and the fuel injection amount f1 calculated by the above-mentioned fuel injection amount calculation portion A0 is changed to 0, whereby the fuel is prohibited from being supplied to the internal combustion engine 2.

Figure 3:
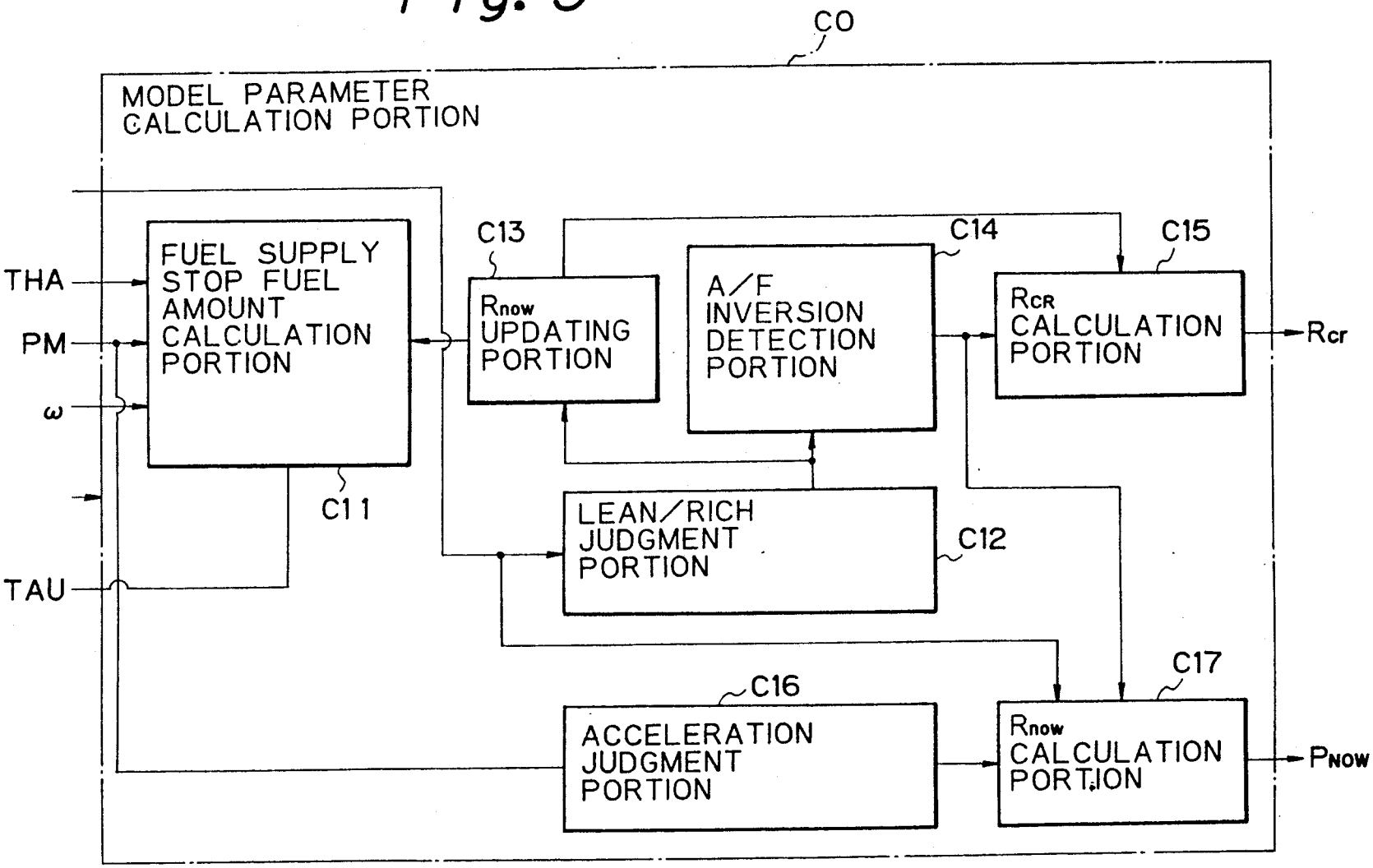
FIG. 3 is a block diagram showing the model parameter calculation portion for calculating the model parameter by a first method.

The model parameter calculation portion of the present invention may adopt the following two types of methods:

That is, in the first method, the model parameter calculation portion is constructed as shown in FIG. 3 and is made to operate when it is judged that the conditions stand for execution of the fuel supply stop control at the fuel supply stop judgement portion B1 of the fuel supply stop control portion B0 (that is, upon execution of fuel supply stop control). First, at a fuel supply stop injection amount calculation portion C11, when a predetermined time elapses after start of the fuel supply stop control, the amount of fuel injection TAU necessary for supplying the stoichiometric air-fuel ratio of an air-fuel mixture into the cylinder 2a of the internal combustion engine 2 is calculated and the fuel injection is executed compulsorily just once. Further, the fuel supply stop injection amount calculation portion C11 calculates the amount of fuel (stoichiometric fuel amount) TAU0 necessary for controlling the air-fuel mixture flowing into the cylinder 2a of the internal combustion engine 2 to the stoichiometric air-fuel ratio in the same way, for example, as the above-mentioned cylinder air flow calculation portion A4 and the target fuel amount calculation portion A5 based on the rotational speed $\omega$ of the internal combustion engine 2 and the intake pipe pressure PM. Based on the stoichiometric fuel amount TAU0 and the later mentioned learned value $R_{NOW}$ of the model parameter R updated by an $R_{NOW}$ updating portion C13 and using the following equation (36), the fuel injection amount TAU for correction of the control law is calculated.

$$TAU = TAU0/(1 - R_{NOW}) \quad (36)$$

That is, if a predetermined time passes after the start of the fuel supply stop control, fuel is not present in the intake system. If at this time fuel injection is performed from the fuel injector 32, all of the injected fuel is considered to flow into the cylinder 2a except for the part that sticks to the walls of the intake pipe, so by calculating the control law correction fuel injection amount TAU from the fuel injector 32 from the learned value $R_{NOW}$ of the model parameter R expressing the rate of sticking of the injected fuel to the walls of the intake pipe and the stoichiometric fuel amount TAU0 to be supplied in the cylinder 2a, it is possible to get the stoichiometric air-fuel ratio of an air-fuel mixture supplied into the cylinder 2a.

If the control law correction fuel injection amount TAU is calculated by the fuel supply stop injection amount calculation portion C11 and the fuel injection is executed in this way, a lean/rich judgement portion C12 judges if the air-fuel ratio detected by the air-fuel ratio sensor 19 is lean or rich. The result of the judgement of this air-fuel ratio is input to an $R_{NOW}$ calculation portion C13. If the result of the judgement is lean, the learned value $R_{NOW}$ having a model parameter R as an initial value for correcting the air-fuel ratio to the rich side is increased, while if it is rich, the learned value $R_{NOW}$ for correcting the air-fuel ratio to the lean side is decreased. The learned value $R_{NOW}$ is updated by this process.

Further, the result of judgement of the lean/rich judgement portion C12 is input to an A/F inversion detection portion C14. This A/F inversion detection portion C14 detects if the result of judgement of the lean/rich judgement portion C2 has reversed from lean to rich or from rich to lean. If it is detected by the A/F inversion detection portion C14 that the air-fuel ratio has inverted, the $R_{CR}$ calculation portion C15 operates and the mean value of the latest learned value $R_{NOW}$ updated by the $R_{NOW}$ updating portion C3 and the previous learned value $R_{BF}$ is calculated as the true value $R_{CR}$ of the model parameter R.

That is, by using the above-mentioned equation (36) when executing the fuel supply stop control, performing fuel injection by the control law correction fuel injection amount TAU, and judging if the air-fuel ratio is lean at that time or not, it is judged if the learned value $R_{NOW}$ of the model parameter R used for the calculation of the control law correction fuel injection amount TAU is larger than in the actual fuel dynamics (if the air-fuel ratio is lean, the rate of sticking of the injected fuel to the walls of the intake pipe is large, so the learned value $R_{NOW}$ is smaller than in the actual situation). By updating the learned value $R_{NOW}$ based o the results of the judgement, the control law correction fuel injection amount TAU next calculated using the equation (36) is corrected to the stoichiometric air-fuel ratio side and then, if the result of judgement of the air-fuel ratio inverts from lean to rich or rich to lean, the learned values $R_{NOW}$ before and after the inversion are the closest to the actual fuel dynamics and the mean value $R_{CR}$ is set as the true value of the model parameter R.

Further, the intake pipe pressure PM detected by the intake pressure sensor 12 is input to an acceleration judgement portion C16, at which acceleration judgement portion C16 it is judged from the state of change of the intake pipe pressure PM is the internal combustion engine 2 is accelerating. The result of judgement is input to a $P_{NOW}$ calculation portion C17. The $P_{NOW}$ calculation portion C17 deems that the learning conditions stand for the model parameter P and updates the learned value $P_{NOW}$ of the model parameter based on the detection signals from the air-fuel ratio sensor 19 when the acceleration judgement portion C16 judges that the internal combustion engine 2 is in acceleration operation within a predetermined time after detection of inversion of the air-fuel ratio by the A/F inversion detection portion C14. The updated learned value $P_{NOW}$ is input to the above-mentioned model error calculation portion A11 as the true value of the model parameter P. That is, the predetermined time after detection of inversion of the air-fuel ratio by the A/F inversion detection portion C14 is just after the true value $R_{CR}$ of the model parameter R is calculated by the $R_{CR}$ calculation portion C15, so the fuel injection control is not affected by the error of the model parameter R and the control error may be considered to arise due to the error of the model parameter P, so at the $P_{NOW}$ calculation portion C17, the learned value $P_{NOW}$ of the model parameter P is updated from the state of the air-fuel ratio when the internal combustion engine 2 enters acceleration operation within a predetermined time period after inversion of the air-fuel ratio.

While explained in detail later, the updating of the learned value $P_{NOW}$ in the $P_{NOW}$ calculation portion C17 is performed based the error between the time when the air-fuel ratio becomes rich and the time it becomes lean within the above-mentioned predetermined time period after establishment of the learning conditions. This is because during acceleration of the internal combustion engine 2 where the above learning conditions stand, the delayed response of the intake system results in a large deviation of the air-fuel ratio to the lean side, then a large deviation to the rich side. When the air-fuel ratio converges to the stoichiometric air-fuel ratio and the lean time and rich time of the air-fuel ratio at that time match, it is judged that the air-fuel ratio of the steady state operation is being controlled to the stoichiometric air-fuel ratio. That is, when the learn time during acceleration of the internal combustion engine 2 is longer than the rich time, the amount of fuel sticking to the walls of the intake pipe flowing into the cylinder 2a becomes small and conversely when the rich time becomes longer than the lean time, the amount of fuel sticking to the walls of the intake pipe flowing into the cylinder 2a is considered to be large, so by correcting the learned value $P_{NOW}$ of the model parameter showing the rate of remainder of the fuel sticking to the walls of the intake pipe so that the error between the lean and rich times is eliminated, the true value of the model parameter P is found.

Further, in the $P_{NOW}$ calculation portion C17, the learned value $P_{NOW}$ of the model parameter is calculated based on the air-fuel ratio at the time of acceleration of the internal combustion engine 2 because the air-fuel ratio fluctuates tremendously during transitional operating of the internal combustion engine 2 and in such transitional operation, during acceleration of the internal combustion engine 2, the fuel sticking to the walls is completely sucked in by the negative pressure in the cylinder 2a, making the dynamics of the stuck fuel unstable and making it impossible to accurately estimate the model parameter P during steady state operation. That is, the learned value $P_{NOW}$ is updated based o the air-fuel ratio during acceleration, when the air-fuel ratio changes tremendously from lean to rich and further the dynamics of the fuel sticking to the walls is stable, thereby enabling accurate calculation of the true value of the model parameter P (that is, the learned value $P_{NOW}$).

Figures 4, 4A:
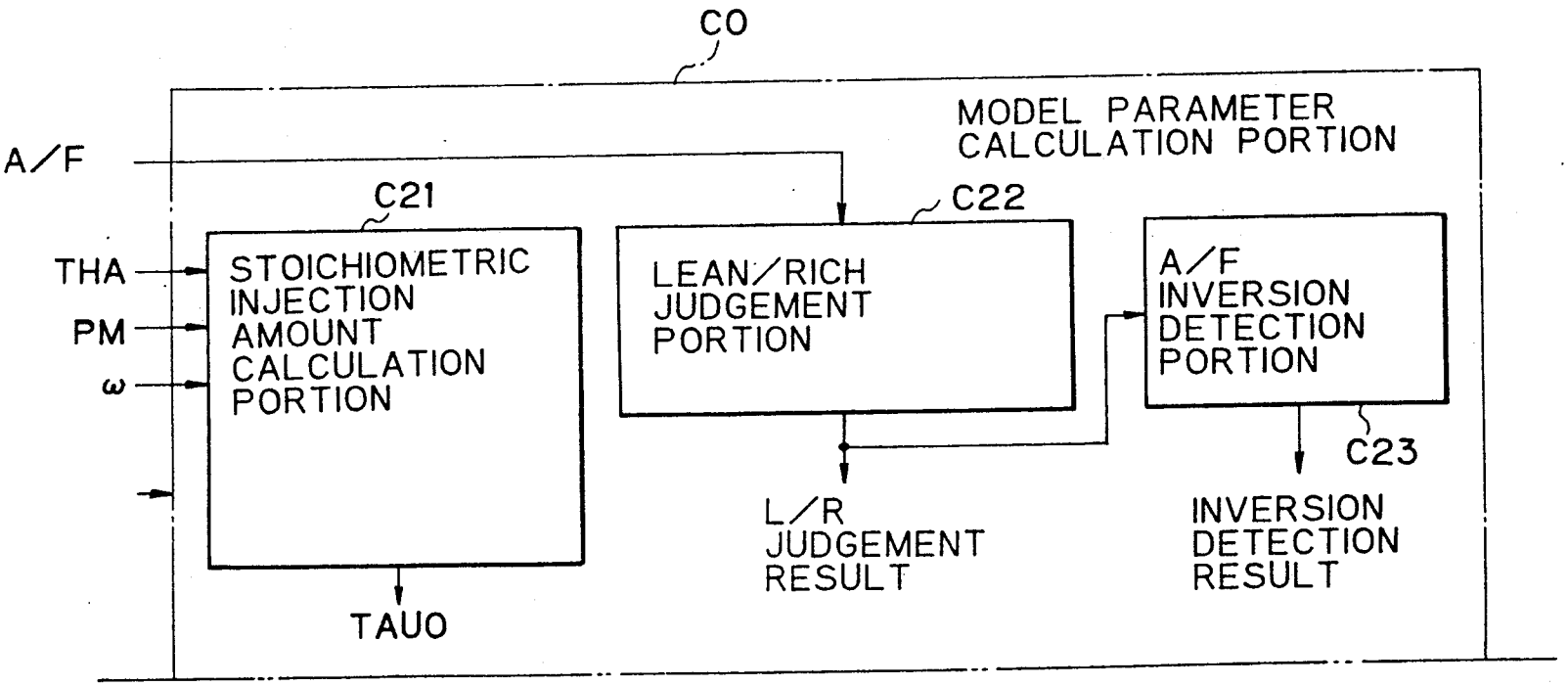
FIG. 4 is a block diagram showing a model parameter calculation portion for calculating the model parameter by a second method.
Figure 4B:
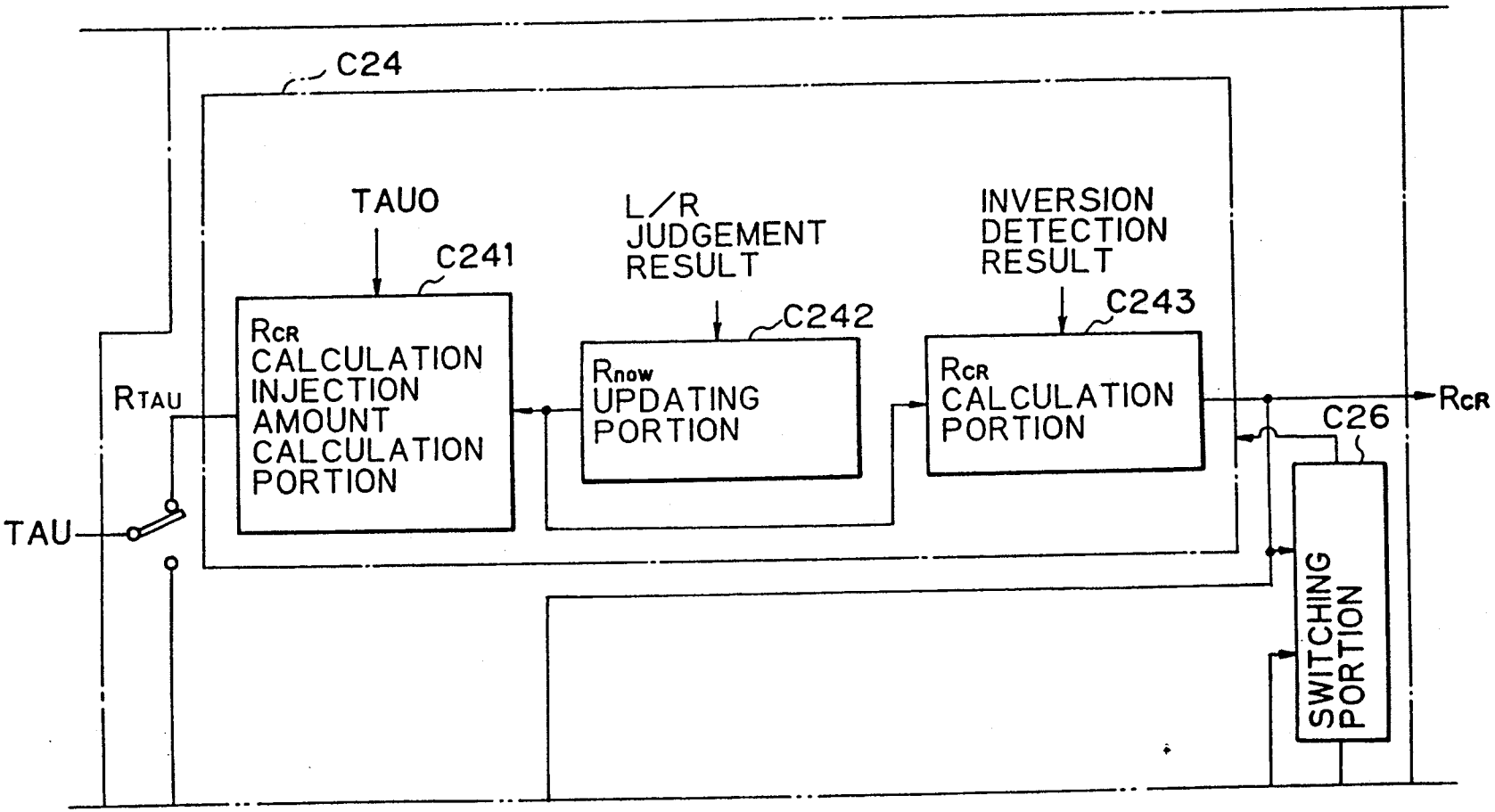
Figure 4C:
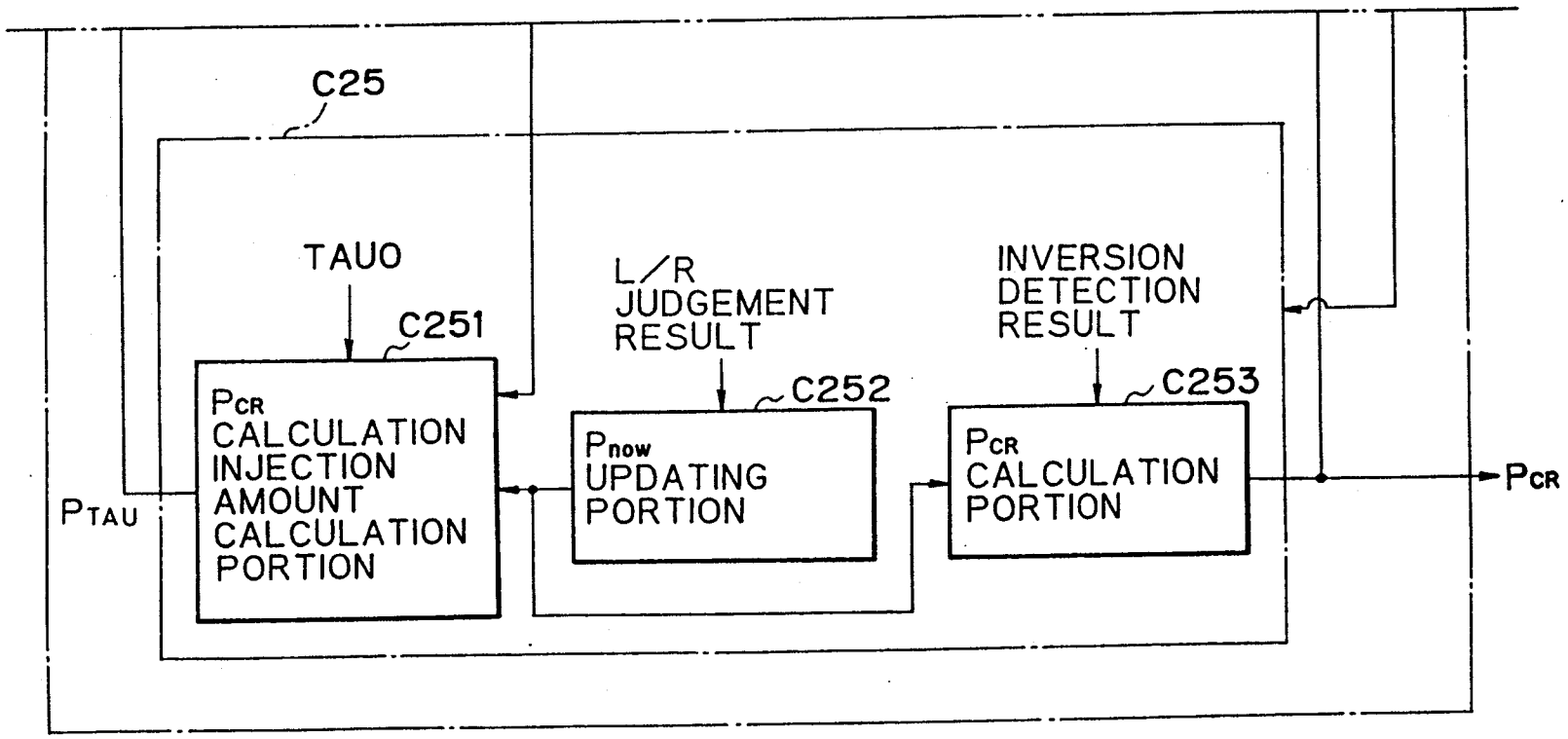

Next, in the second method, the model parameter calculation portion is constructed as shown in FIG. 4 and operates when the fuel supply stop judgement portion B11 of the fuel supply stop control portion B0 judges that the conditions stand for execution of the fuel supply stop control (that is during execution of the fuel supply stop control).

That is, by the switching operation of a switching portion C26, after the startup of the internal combustion engine 2, in the interval until the true value $R_{CR}$ of the model parameter R is calculated by the $R_{CR}$ learning updating portion C24, the $R_{CR}$ learning updating portion C24 operates with each fuel supply stop, the true value $R_{CR}$ of the model parameter R is calculated by the $R_{CR}$ learning updating portion C24, and then, in the interval until the true value $P_{CR}$ of the model parameter P is calculated by the $P_{CR}$ learning updating portion C25, the $P_{CR}$ learning updating portion C25 operates.

Next, in the $R_{CR}$ learning updating portion C24, first, when a predetermined time elapses after the start of the fuel supply stop control, the $R_{CR}$ calculation injection amount calculation portion C241 calculates the first control law correction fuel injection amount, that is, the $R_{CR}$ calculation injection amount $R_{TAU}$, using the following equation (37) based on the stoichiometric injection amount TAU0 calculated by the stoichiometric injection amount calculation portion C1 and the learned value $R_{NOW}$ of the model parameter R updated by the later mentioned $R_{NOW}$ updating portion C242 and performs a single fuel injection by that injection amount $R_{TAU}$.

$$R_{TAU} = TAU0/(1 - R_{NOW}) \quad (37)$$

When fuel injection is performed by the $R_{CR}$ calculation injection amount calculation portion C241, the $R_{NOW}$ updating portion C242 increases the learned value $R_{NOW}$ having as its initial value a model parameter to correct the air-fuel ratio to the rich side when the air-fuel ratio is lean, based on the results of the judgement of the air-fuel ratio by the lean/rich judgement portion C22, and, conversely, reduces the learned value $R_{NOW}$ to correct the air-fuel ratio to the lean side when it is rich. The learned value $R_{NOW}$ is updated by this procedure.

Further, when the result of the judgement of the lean/rich judgement portion C22 inverts due to the fuel injection 2 of the $R_{CR}$ calculation injection amount calculation portion C241 and that is detected by the A/F inversion detection portion C23, the $R_{CR}$ calculation portion C43 operates and the mean value of the latest learned value $R_{NOW}$ updated by the $R_{NOW}$ updating portion C24 and the previous learned value $R_{BF}$ is calculated as the true value $R_{CR}$ of the model parameter R.

On the other hand, in the $P_{CR}$ learning updating portion C25, first, when a predetermined time elapses after the start of the fuel supply stop control, the $P_{CR}$ calculation injection amount calculation portion C251 calculates the second control law correction fuel injection amount, that is, the $P_{CR}$ calculation injection amount $P_{TAU}$, using the following equation (38) based on the stoichiometric injection amount TAU0 calculated by the stoichiometric injection amount calculation portion C21, the true value $R_{CR}$ of the model parameter R calculated by the $R_{CR}$ learning updating portion C24, and the learned value $P_{NOW}$ of the model parameter P updated by the later mentioned $P_{NOW}$ updating portion C252 and performs two fuel injections by that injection amount $P_{TAU}$.

$$P_{TAU}=TAU0/(1-P_{NOW}\cdot R_{CR}) \quad (38)$$

When fuel injection is performed twice by the $P_{CR}$ calculation injection amount calculation portion C251, the $P_{NOW}$ updating portion C252 updates the learned value $P_{NOW}$ in the same way as the $R_{NOW}$ updating portion C242 based on the based on the results of the judgement of the air-fuel ratio by the lean/rich judgement portion C22.

Further, when the result of the judgement of the lean/rich judgement portion C22 inverts due to the two fuel injections of the second control law correction and that is detected by the A/F inversion detection portion C23, the $R_{CR}$ calculation portion C243 operates and the mean value of the latest learned value $P_{NOW}$ updated by the $P_{NOW}$ updating portion C252 and the previous learned value $P_{BF}$ is calculated as the true value $P_{CR}$ of the model parameter P in the same way as the above $R_{CR}$ calculation portion C243.

Below, an explanation will be made of the reasons for constructing the learning updating portions C24 and C25 in this way.

First, during execution of the fuel supply stop control, there is no fuel present in the intake pipe 4, so if at this time a single fuel injection is performed the second control law correction, the $\hat{f}w(k)$ and $\hat{f}v(k)$ in the above-mentioned equations (1) and (2) become 0. Further, in the fuel injection for correction of the control law during the fuel supply stop control, the amount of evaporated fuel $\hat{f}v(k+1)$ remaining in the intake 4 is very small compared with the amount of fuel $\hat{f}w(k+1)$ sticking to the walls, so the clause of $\hat{f}v$ in equation (1) may be ignored. Further, the amount of fuel evaporation Vfw from the walls of the intake pipe is considered to be included in the model parameter P. This being so, during execution of the fuel supply stop control, the fuel dynamic model at the time of a single first control law correction fuel injection becomes:

$$\hat{f}w(k+1)=R\cdot fi(k) \quad (39)$$

$$fc(k)=(1-R)fi(k) \quad (40)$$

The fuel injection amount fi for making the cylinder fuel flow amount fc the stoichiometric injection amount TAU0 may be derived from the following equation, which is a modification of the above equation (40):

$$fi(k)=TAU0/(1-R) \quad (41)$$

When fuel injection is performed by the fuel injection amount fi found by the equation (41), if the model parameter R corresponds to the actual fuel dynamics, the air-fuel ratio becomes the stoichiometric air-fuel ratio.

Therefore, in the $R_{CR}$ learning updating portion C4, use is made of the above-mentioned equation (37) with the model parameter R of the above equation (41) replaced with the learned value $R_{NOW}$ so as to calculate the $R_{CR}$ calculation injection amount TAU and the first control law correction fuel injection is performed once at the time of execution of the fuel supply stop control. Also, the learned value $R_{NOW}$ is updated depending on whether the air-fuel ratio after the first control law correction fuel injection is rich or lean, then if the air-fuel ratio inverts (that is, the air-fuel ratio cuts across the stoichiometric air-fuel ratio), the learned values $R_{NOW}$ before and after the inversion are closest to the actual fuel dynamics, so the mean value is set as the true value $R_{CR}$ of the model parameter R.

By performing the first control law correction fuel injection during the execution of the fuel supply stop control and detecting the air-fuel ratio after the fuel injection, it becomes possible to find the true value $R_{CR}$ of the model parameter R expressing the rate of sticking of the injected fuel to the walls of the intake pipe, but as clear from equations (39) and (40), with a single first control law correction fuel injection during execution of the fuel supply stop control, the clause of the model parameter P expressing the rate of remainder of the fuel sticking to the intake pipe does not show up in the fuel dynamics, so it is not possible to find the true value $P_{CR}$.

However, when the second control law correction fuel injection is performed twice during execution of the fuel supply stop control, fuel sticks to the walls of the intake pipe due to the first injection, so the cylinder fuel flow amount fc after the second fuel injection becomes as shown in equation (42):

$$fc(k)=(1-P)\,\hat{f}w(k)+(1-R)fi(k) \quad (42)$$

If the second fuel injection amount fi(k) is the same, the amount of fuel $\hat{f}w(k)$, sticking to the walls of the intake pipe due to the first fuel injection is as shown in the equation (39), so the above-mentioned equation (42) may be modified as shown by the following equation (43):

$$fc(k)=(1-P)\cdot R\cdot fi(k)+(1-R)fi(k) \quad (43)$$

Therefore, the second control law correction injection fi for making the cylinder fuel flow amount fc the stoichiometric injection amount TAU0 may be derived from the following equation (44) modified from the above equation (43):

$$fi(k)=TAU0/(1-P\cdot R) \quad (44)$$

When performing two fuel injections by the fuel injection amount fi found by the equation (44), if the model parameters R and P correspond to the actual fuel dynamics, the air-fuel ratio becomes the stoichiometric air-fuel ratio.

The $P_{CR}$ learning updating portion C5 calculates the $P_{CR}$ calculation injection amount $P_{TAU}$ using the above-mentioned equation (38) with the model parameter R of equation (44) replaced with the true value $R_{CR}$ found by the $R_{CR}$ learning updating portion C4 and the model parameter P replaced with the learned value $R_{NOW}$ and performs two fuel injections during execution of the fuel supply stop control and, further, in the same way as in the calculation of $R_{CR}$, proceeds to update the learned value $P_{NOW}$ by whether the air-fuel ratio after the fuel injection is rich or lean. If the air-fuel ratio inverts after this, the learned values $P_{NOW}$ before and after the inversion becomes closest to the actual fuel dynamics, so the mean value is set as the true value $P_{CR}$ of the model parameter.

Next, an explanation will be made of the fuel injection control executed in actuality by the electronic control circuit 30 in accordance with the control law in the case of use of the first method as the model parameter calculation portion, using the flow charts shown in FIG. 5 to FIG. 8. In the following explanations, amounts dealt with in the current processing are expressed with the suffix (k) and values found in the previous processing (that is, one cycle of the internal combustion engine 2 before) are expressed by the suffix (k−1).

Figures 5, 5A:
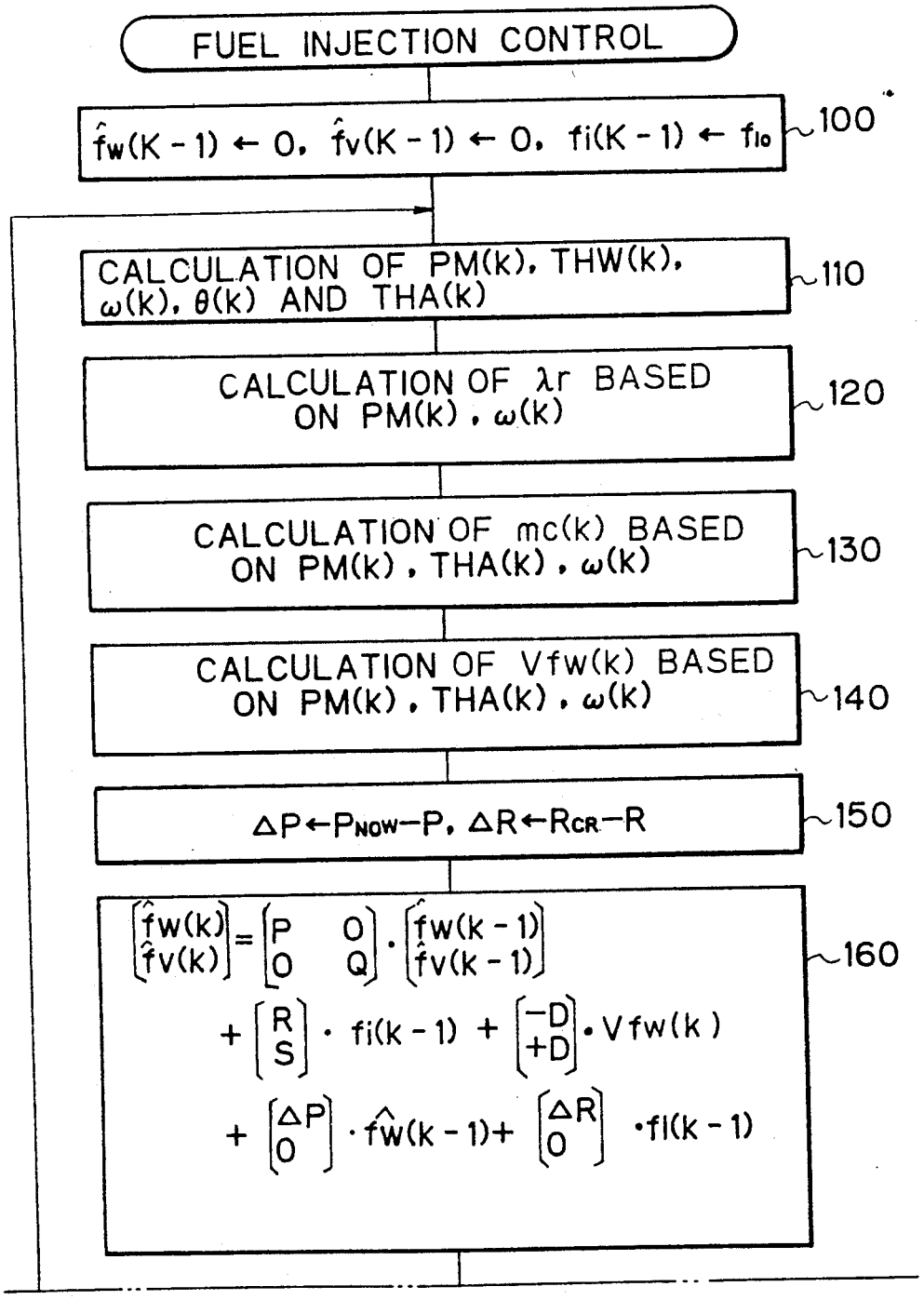
FIG. 5 is a flow chart showing a first embodiment of a main routine for controlling the fuel injection performed by an electronic control circuit.
Figure 5B:
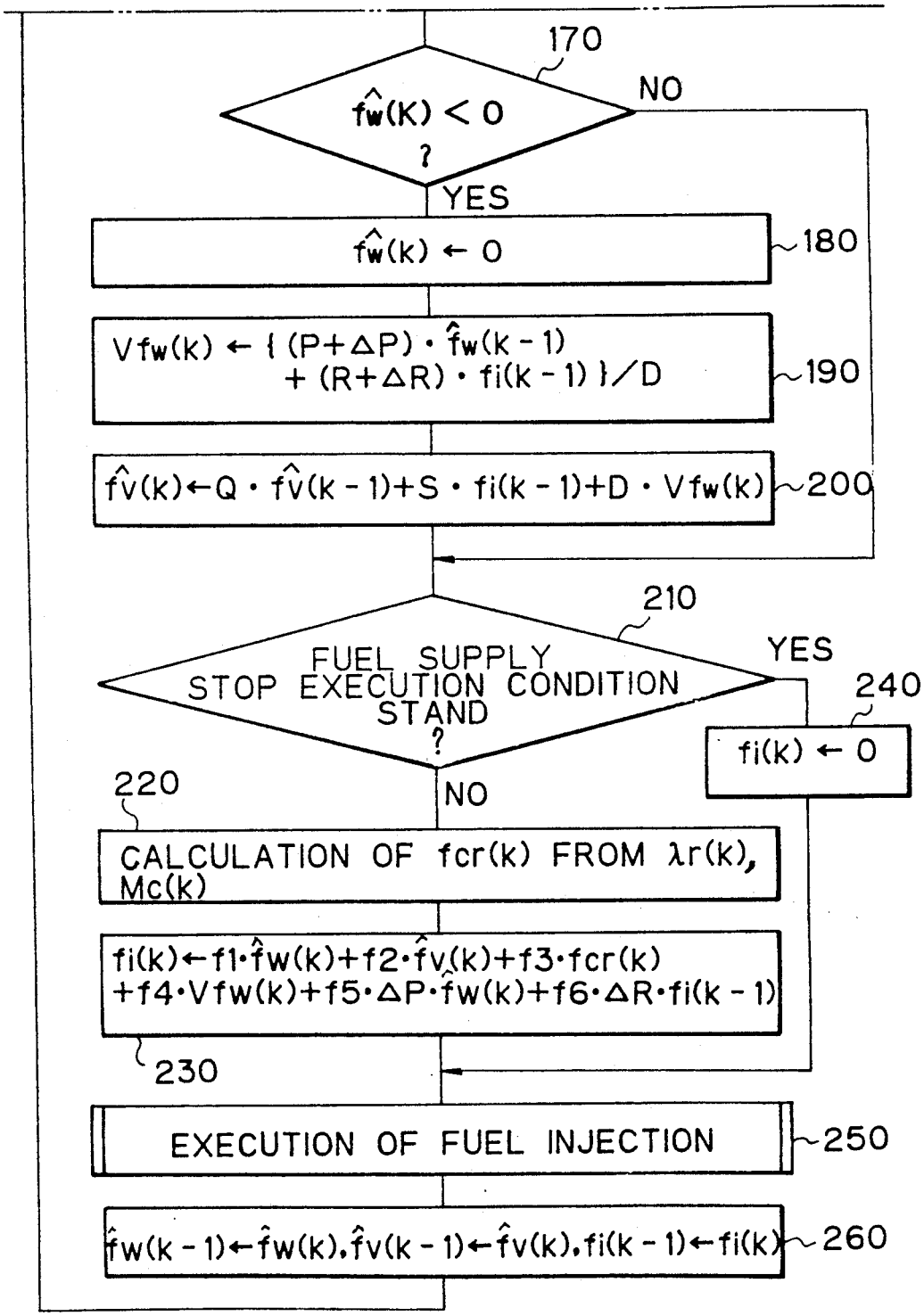

First, FIG. 5 is a flow chart showing a main routine for control of the fuel injection started together with the startup of the internal combustion engine 2 and performed repeated during operation of the internal combustion engine 2.

As shown in the figure, when the processing is started, first step 100 is executed and predetermined initial values are set for the amount of sticking fuel $\hat{f}w(k-1)$, the amount of evaporated fuel $\hat{f}v(k-1)$, and the amount of fuel injection fi(k−1). Next, at the following step 110, based on the output signals from the above-mentioned sensors, the intake pipe pressure PM(k), the intake temperature THA(k), the rotational speed ω(k) of the internal combustion engine 2, the throttle opening θ(k), and the coolant water temperature THW(k) are calculated.

Next, at step 120, the target air-fuel ratio λr for the load of the internal combustion engine 2 is calculated based on the intake pipe pressure PM(k) and the rotational speed ω(k) of the internal combustion engine 2. Further, at step 120, the target air-fuel ratio λr is set so that the air ratio usually becomes 1 (the stoichiometric air-fuel ratio). During light load operation of the internal combustion engine 2, the fuel is reduced from the usual and the fuel consumption is improved by setting the target air-fuel ratio λr to the lean side.

When the target air-fuel ratio λr(k) is set at step 120, the control proceeds to step 130, where the above-mentioned equation (4) or data map is used and the processing as the cylinder air flow calculation portion A4 is executed for calculating the amount of air mc(k) flowing into the cylinder 2a based on the intake pipe pressure PM(k), the intake temperature THA(k), and the rotational speed ω(k) of the internal combustion engine 2.

At the following step 140, the processing as the fuel evaporation rate calculation portion A1 and the fuel evaporation amount calculation portion A2 is executed to find the evaporation rate Vf of the fuel sticking to the walls based on the coolant water temperature THW(k) and the intake pipe pressure PM(k) and, by dividing that value by the rotational speed ω(k) of the internal combustion engine 2, to calculate the amount of fuel Vfw(k) evaporating from the walls of the intake pipe during one cycle of the internal combustion engine 2 (that is, the fuel evaporation amount).

At the following step 150, the processing as the model error calculation portion A11 is executed to calculate, as the model error, the errors ΔR and ΔP true values $R_{CR}$ and $P_{NOW}$ of the model parameters R and P calculated by the later mentioned $R_{CR}$ calculation processing and $P_{NOW}$ calculation processing and the model parameters P and R of the fuel dynamic model used in the design of the control apparatus, then the control shifts to step 160, where processing as the state variable estimation portion A7 is performed to estimate the state variable amounts, that is, the amount of sticking fuel $\hat{f}w(k)$ and the amount of evaporated fuel $\hat{f}v(k)$ using the above-mentioned equation (8) based on the thus calculated model errors ΔR and ΔP, the amount of fuel evaporation Vfw(k) found at step 140, the previous fuel injection amount fi(k−1), and the state variable amounts $\hat{f}w(k-1)$) and $\hat{f}v(k-1)$ previously found at step 160.

When the amount of sticking fuel $\hat{f}w(k)$ is calculated at step 160 in this way, the control shifts to step 170, where judgement is made if the value $\hat{f}w(k)$ is a practically impossible negative value. When the amount of sticking fuel $\hat{f}w(k)$ is a negative value, the control proceeds to step 180, where the value of the amount of sticking fuel $\hat{f}w(k)$ changes to 0. Then, at the next step 190, the amount of fuel evaporation Vfw(k) is recalculated using the following equation based on the previous amount of fuel injection fi(k−1) and the amount of sticking fuel $\hat{f}w(k-1)$ used for the calculation of the fuel injection amount fi(k−1):

$$Vfw(k)=\{(P+\Delta P)\cdot\hat{f}w(k-1)+(R+\Delta R)\cdot fi(k-1)\}/D \quad (45)$$

This equation (45) is obtained by making the amount of sticking fuel $\hat{f}w$ of the left side of the equation (6) 0, replacing the parameters (1−α2), α4, and α5 with P, R, and D, respectively, and further arranging it so that the errors ΔP and ΔR are included in the model parameters P and R.

At the next step 200, the amount of evaporated fuel $\hat{f}v(k)$ is recalculated using the following equation based on the thus calculated amount of fuel evaporation Vfw(k), the previous fuel injection amount fi(k−1), and the amount of sticking fuel $\hat{f}w(k-1)$ used for the calculation of the previous fuel injection amount fi(k−1):

$$\hat{f}v(k)=Q\cdot\hat{f}v(k-1)+S\cdot fi(k-1)+D\cdot Vfw(k) \quad (46)$$

Further, this equation (46) was obtained by replacing the parameters (1−α3), α6, and α5 of the above-mentioned equation (7) with Q, S, and D, respectively.

The processing of the step 190 and step 200 is for setting the fuel evaporation amount Vfw and the amount of evaporated fuel fv in the case of an amount of fuel fw sticking to the walls of the intake pipe of 0 to the accurate values. That is, at step 140, based on the intake pipe pressure PM, coolant water temperature THW, and rotational speed ω, it is deemed that the fuel has sufficiently stuck to the walls of the intake pipe and the fuel evaporation amount Vfw is calculated, but in actuality the amount of sticking fuel fw calculated at step 160 becomes a negative value and the fuel sticking to the intake pipe sometimes completely evaporates before the next intake stroke, so the amount of evaporated fuel Vfw in this case is recalculated assuming that the amount of sticking fuel fw at the time of the next intake stroke becomes 0 and, further, the amount of evaporated fuel fv is recalculated based on the results of that calculation.

Next, if it is judged at step 170 that the amount of sticking fuel $\hat{f}w(k)$ is not a negative value or it judged at step 170 that the amount of sticking fuel $\hat{f}w(k)$ is a negative value and the processing of steps 180 to 200 is executed, the control proceeds to step 210 and the processing is performed as the fuel supply stop judgement portion B1 for judging if the conditions stand for execution of the fuel supply stop control of the rotational speed ω of the internal combustion engine 2 is higher than a predetermined speed and the throttle opening θ is fully open.

If it is judged at step 210 that the conditions do not stand for execution of the fuel supply stop control, the control then shifts to step 220, where the processing is performed as the target fuel amount calculation portion A5 to multiply the target air-fuel ratio λr(k) set at step 120 and the amount of air m(k) found at step 130 to calculate the target fuel amount fcr(k) {=λr·mc}, then the control shifts to step 230, where the fuel injection amount fi(k) is calculated using the above-mentioned equation (35) based on the amount of fuel evaporation Vfw(k), the amount of sticking fuel $\hat{f}w(k)$, the amount of evaporated fuel $\hat{f}v(k)$, and the target fuel amount fcr(k) found at the above steps and the model errors ΔP and ΔR, after which the control proceeds to step 250.

On the other hand, if it is judged at step 210 that the conditions stand for execution of fuel supply stop control, the control proceeds to step 240, where the processing is performed as the fuel supply stop execution portion B2 to deem the fuel injection amount fi(k) as 0 and prohibit the fuel injection, then the control proceeds to step 250.

Then, at step 250, at a fuel injection timing determined based on the detection signals from the crank angle sensor 24, the fuel injection execution processing is performed to open the fuel injector 32 in accordance with the fuel injection amount fi(k) and the fuel injected. At the next step 260, the state variable amounts $\hat{f}w(k)$, $\hat{f}v(k)$, and the fuel injection amount fi(k) found by the current processing are respectively replaced with $\hat{f}w(k-1)$, $\hat{f}v(k-1)$, and fi(k−1), then the control again shifts to step 110. When 0 is set in for the fuel injection amount fi(k) at step 240, the fuel injector 32 does not open at step 250 and when the fuel injection timing is reached, step 260 is executed as it is.

Figures 6, 6A:
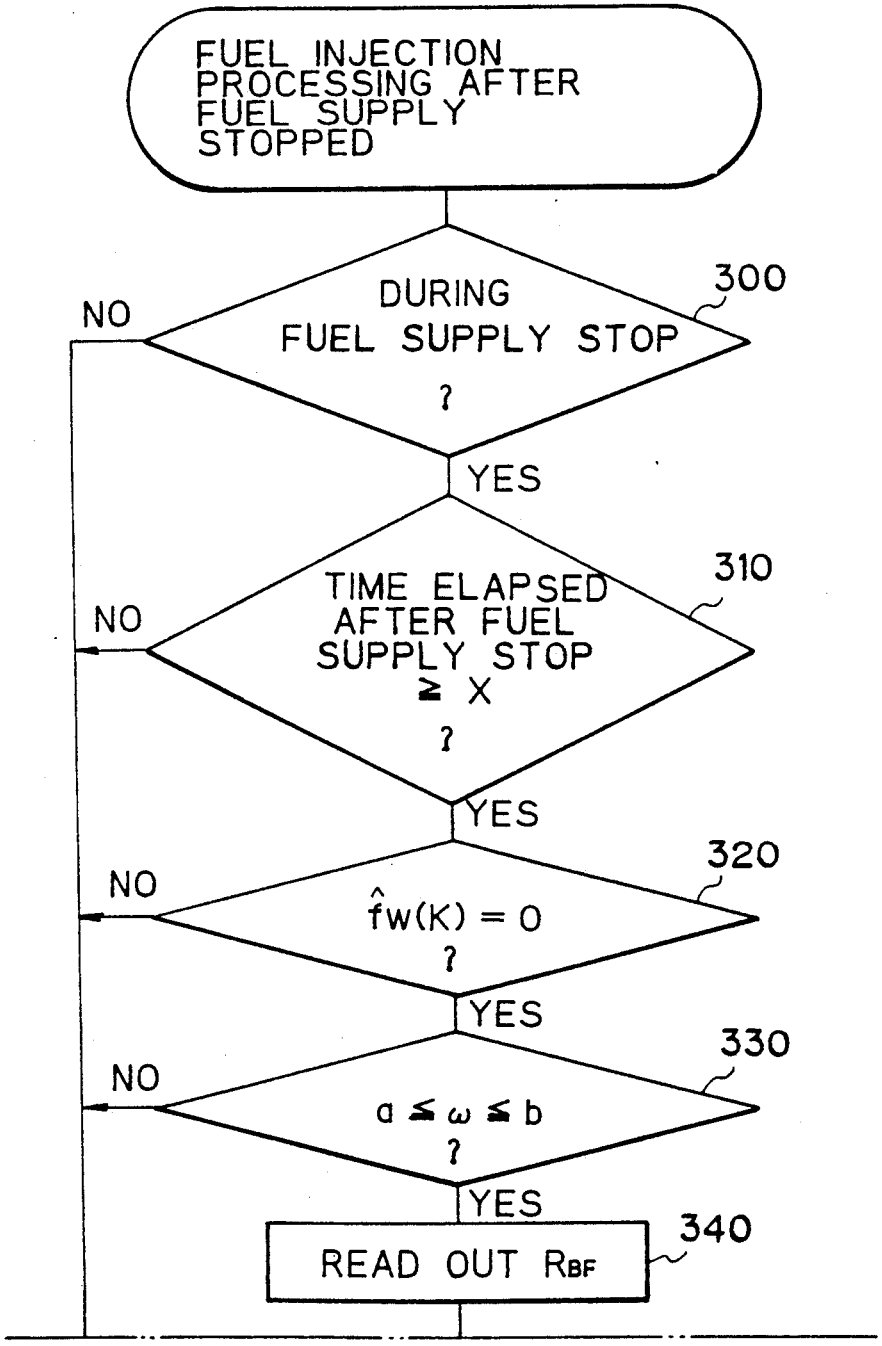
FIG. 6 is a flow chart showing fuel injection processing after fuel supply stopped executed each time an internal combustion engine rotates 30° CA by an electronic control circuit.
Figure 6B:
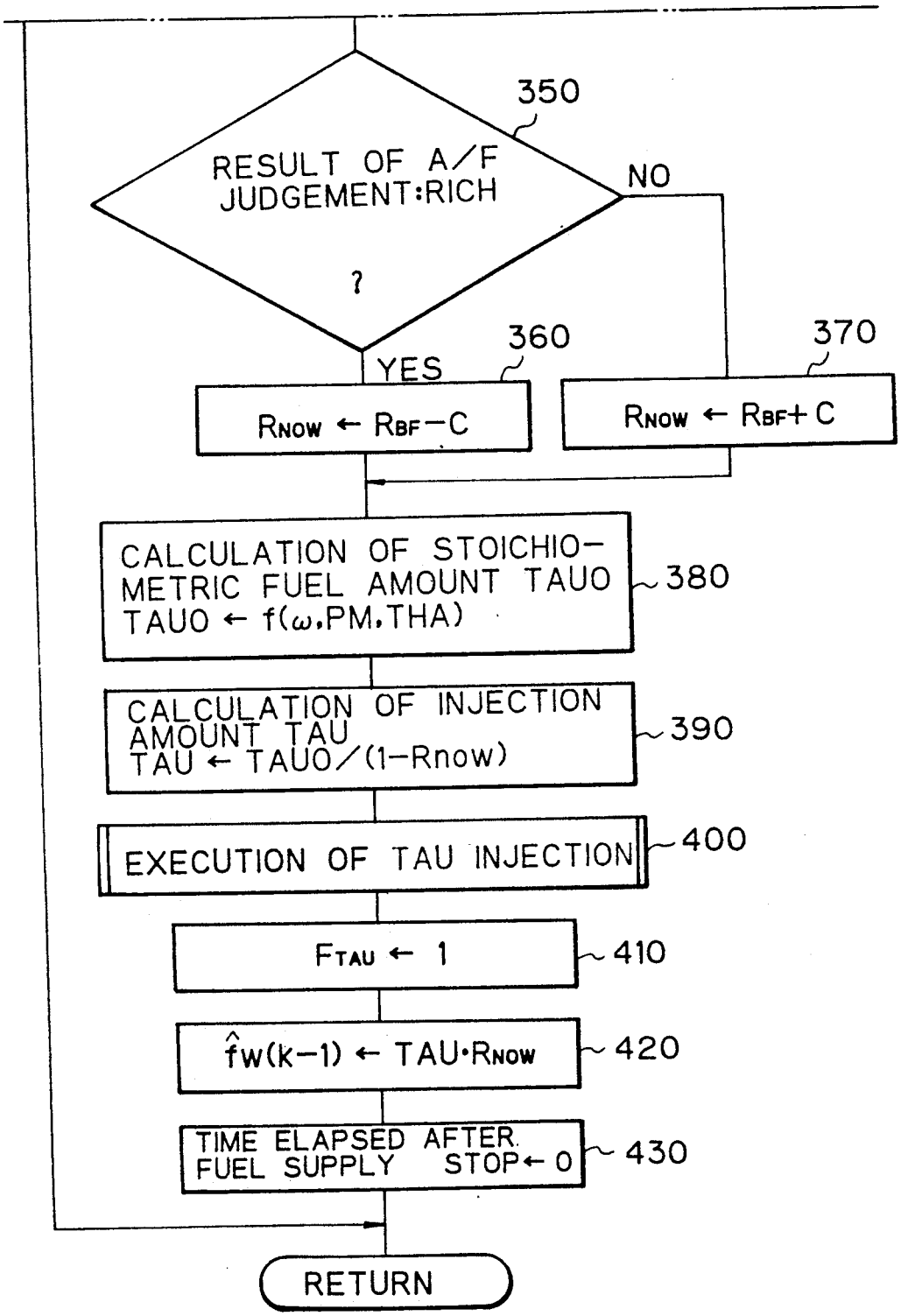

Next, FIG. 6 is a flow chart showing fuel injection processing after fuel supply stopped executed as an interruption processing each time an internal combustion engine 2 rotates 30° CA in the main routine of FIG. 5. The fuel injection processing after fuel supply stopped is realized by the fuel supply stop fuel injection amount calculation portion C21 and the $R_{NOW}$ calculation portion C23 in FIG. 4.

As illustrated, in the fuel injection processing after fuel supply stopped, first, at step 300 it is judged if the fuel supply stop control is being currently executed. If the fuel supply stop control is being executed, then at the following step 310, it is judged if the execution time of the fuel supply stop control has continued for over a predetermined time. If the fuel supply stop time has continued for over the predetermined time, then at the following step 320, it is judged if fuel has not stuck to the walls of the intake pipe by whether or not the amount of sticking fuel $\hat{f}w(k)$ estimated by the main routine of FIG. 5 is 0 or not. If $\hat{f}w(k)=0$ and the fuel has not tuck to the walls of the intake pipe, then at the next step 330, it is judged if the rotational speed ω of the internal combustion engine 2 is in a predetermined range (a to b). If the rotational speed ω is in the predetermined range (a to b), it is deemed that conditions stand for execution of fuel injection during execution of fuel supply stop control and then the control proceeds to step 340. That is, in the processing for fuel supply stop fuel injection, when the judgement is affirmative at steps 300 to 330, it is deemed that the conditions stand for execution of fuel injection during execution of fuel supply stop control, the control proceeds to step 340, and if the judgement is negative at any of steps 300 to 330, it is deemed that the conditions do not stand for execution of fuel injection and the processing ends.

Here, the processing of steps 300 to 320 is for confirming there is no fuel present in the intake pipe 4 by the fuel supply stop control. The processing of step 330 is for adjusting the operating conditions of the internal combustion engine 2 during fuel injection and updating of the learned value $R_{NOW}$ to prevent erroneous learning of the learned value $R_{NOW}$. Further, to adjust the operating conditions of the internal combustion engine 2 for preventing erroneous learning of the learned value $R_{NOW}$, in addition to keeping the rotational speed ω of the internal combustion engine 2 within the predetermined range (a to b) as mentioned above, one may adjust the coolant water temperature THW or the shift position of the transmission.

Next, at step 340, the previous learned value $R_{BF}$ of the model parameter R stored in the RAM 44 by the later mentioned $R_{CR}$ calculation processing is read out. Then, at the next step 350, it is judged if the result of judgement of the air-fuel ratio stored in the RAM 44 is rich in the later mentioned $R_{CR}$ calculation processing due to the previous fuel injection. If the result of judgement of the air-fuel ratio is rich, then at step 360 the value of the previous learned value $R_{BF}$ minus a predetermined value c is calculated as the learned value $R_{NOW}$ and conversely if the result of the judgement of the air-fuel ratio is lean, at step 370, the value of the previous learned value $R_{BF}$ plus the predetermined value c is calculated as the learned value $R_{NOW}$.

In this way, if the learned value $R_{NOW}$ is calculated, the control proceeds to step 380 where the stoichiometric fuel amount TAU0 is calculated based on the current operating conditions (ω, PM, THA) of the internal combustion engine 2, then the control proceeds to step 390, where the control law correction fuel injection amount TAU is calculated using the above-mentioned equation (36) from the stoichiometric fuel amount TAU0 and the learned value $R_{NOW}$. At the next step 400, the fuel injector 32 is opened in accordance with the control law correction fuel injection amount TAU so as to perform control law correction fuel injection at the time of execution of the fuel supply stop control, then control proceeds to step 410 where a fuel injection execution flag $F_{TAU}$ showing that effect is set.

Next, at step 420, the amount of fuel $\hat{f}w(k-1)$ sticking to the walls of the intake pipe is calculated using the following equation based on the control law correction fuel injection amount TAU currently being injected and the learned value $R_{NOW}$ $$\hat{f}w(k-1)=TAU\cdot R_{NOW} \tag{47}$$

so that no error is caused in the results of estimation of the amount of sticking fuel fw in the main routine of FIG. 5. At the next step 430, the time of execution of the fuel supply stop control is set to 0 and the processing is once ended. By the processing of step 430, when the fuel supply stop control continues for a long time (for example, when the vehicle is running on a downward slope), the fuel injection is executed each time a predetermined time elapses after the execution of the fuel supply stop control.

Figure 7A:
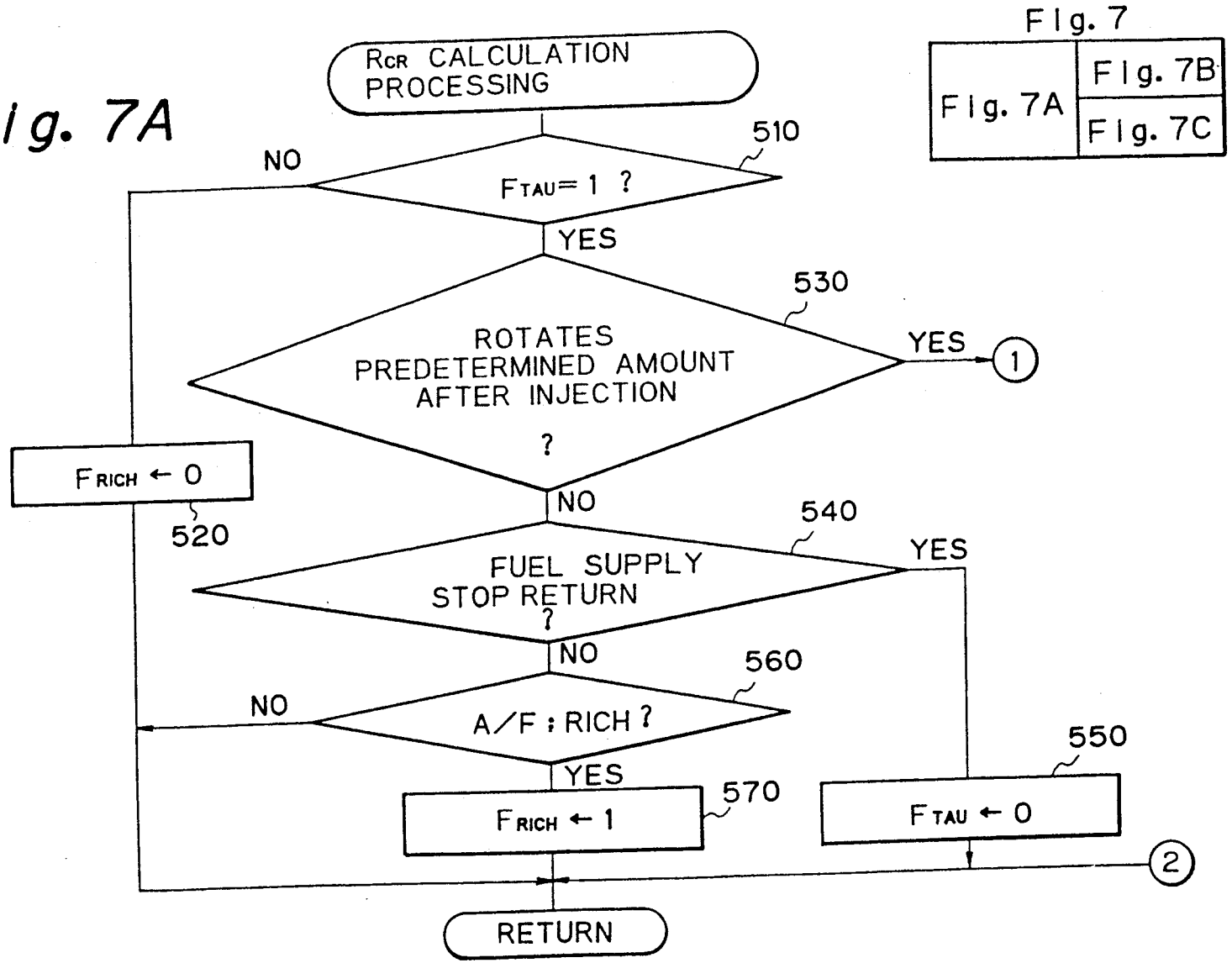
FIG. 7 is a flow chart showing an $R_{CR}$ calculation processing.
Figure 7B:
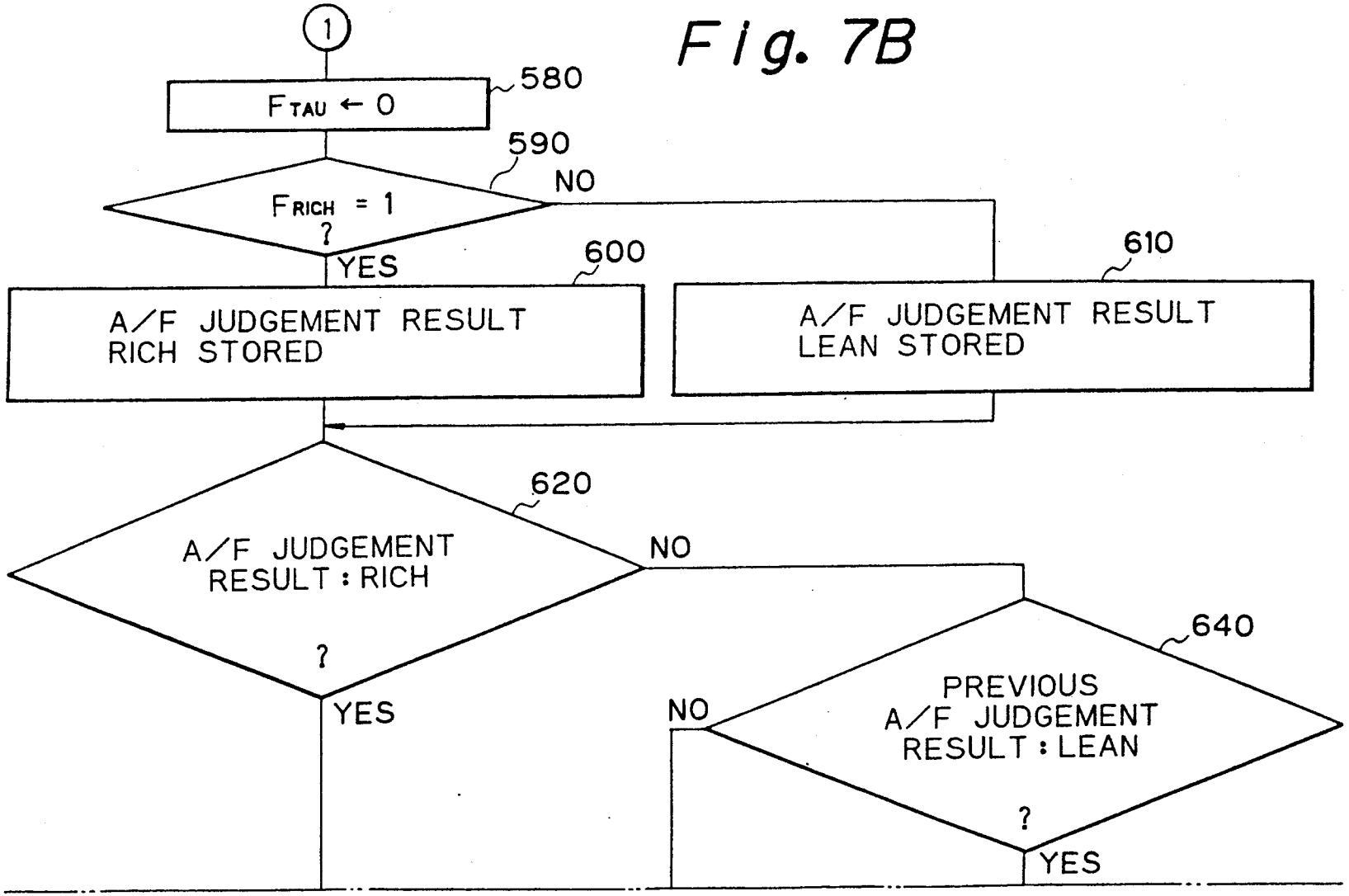
Figure 7C:
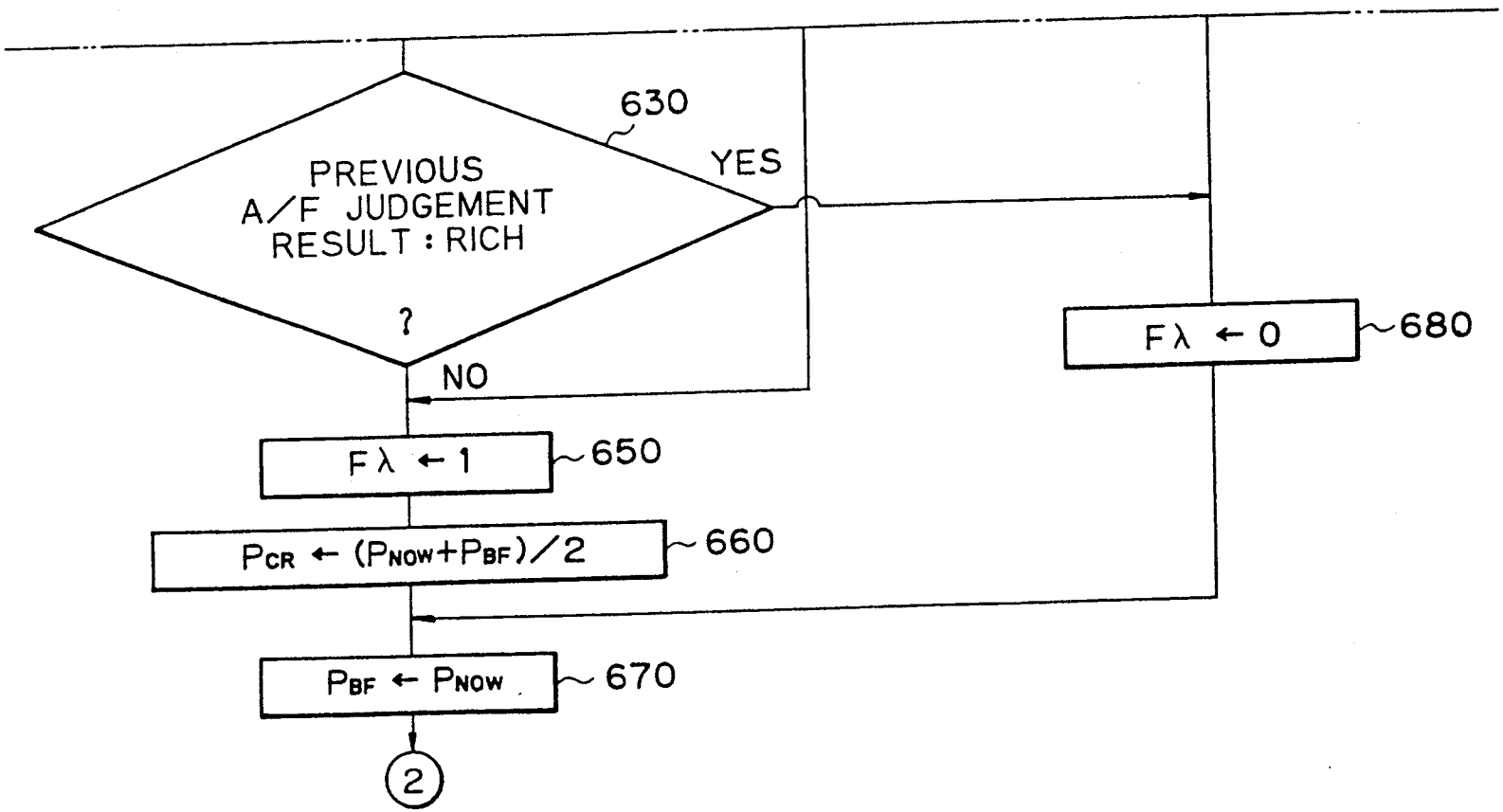

Next, FIG. 7 is a flow chart showing an $R_{CR}$ calculation processing to be executed each time the internal combustion engine 2 rotates 30° C. in the same way as the fuel supply stop fuel injection processing of FIG. 6. This $R_{CR}$ calculation processing realizes the lean/rich judgement portion C12, the air-fuel ratio inversion detection portion C14, and the $R_{CR}$ calculation portion C15 in FIG. 4.

As illustrated, in the $R_{CR}$ calculation processing, first, at step 510, it is judged if the fuel injection execution flag $F_{TAU}$ set upon fuel injection in the previous fuel supply stop fuel injection processing is set or not. If the fuel injection execution flag $F_{TAU}$ is not set, the air-fuel ratio rich flag $F_R$ICH used in the later mentioned processing is reset and the processing is ended.

On the other hand, at step 510, if it is judged that the fuel injection execution flag $F_{TAU}$ is set, then the control proceeds to step 530, where it is judged if the internal combustion engine 2 has rotated a predetermined amount after execution of the control law correction fuel injection during execution of the fuel supply stop control. If the internal combustion engine 2 has not rotated the predetermined amount, the control then proceeds to the next step 540, where it is judged if the operational state of the internal combustion engine 2 has returned from fuel supply stop control to the regular fuel injection control. In the case where it has returned from the fuel supply stop control, the fuel injection execution flag $F_{TAU}$ is reset at step 550, then the processing is once ended. Conversely, if it has returned from the fuel supply stop control, the control proceeds to step 560.

At step 560, it is judged if the current air-fuel ratio is rich based on the detection signals from the air-fuel ratio sensor 19. If the air-fuel ratio is rich, the control proceeds to step 570, where the air-fuel ratio rich flag $F_{RICH}$ is set, and if the air-fuel ratio is lean, the processing is ended as it is.

In the processing of steps 510 to 570, the control law correction fuel injection is executed during the fuel supply stop, then it is judged if the air-fuel ratio has become rich while the internal combustion engine 2 is rotating a predetermined amount. If the air-fuel ratio is rich, the air-fuel ratio rich flag $F_{RICH}$ is set, and if the air-fuel ratio does not become rich, the air-fuel ratio rich flag $F_{RICH}$ is placed in the reset state.

Next, at step 530, if it is judged that the internal combustion engine 2 rotates a predetermined amount after the control law correction fuel injection, the control proceeds to step 580 and the fuel injection execution flag $F_{TAU}$ is reset. At the succeeding step 590, it is judged if the air-fuel ratio after the control law correction fuel injection has become rich by whether the air-fuel ratio rich flag $F_R$ICH is set. If the air-fuel ratio has become rich, then at step 600 data showing the rich state of the air-fuel ratio is stored in the RAM 44 as the result of judgement of the air-fuel ratio after the control law correction fuel injection. If it has not, at step 610, the data showing the lean state of the air-fuel ratio is stored in the RAM 44 as a result of judgement of the air-fuel ratio. Further, the result of judgement is stored in a backup area in the RAM 44 where power is continuously supplied so that this data is not lost even after stopping of the internal combustion engine 2.

Next, at step 620, it is judged if the result of judgement of the air-fuel ratio is rich. If the result of judgement of the air-fuel ratio is rich, the control proceeds to step 630, where it is judged if the previous result of judgement of the air-fuel ratio was also rich. Further, if, at step 620, it is judged that the result of judgement of the air-fuel ratio is lean, the control proceeds to step 640, where it is judged if the previous result of judgement of the air-fuel ratio was also lean.

If, at step 630, it is judged that the previous result of judgement of the air-fuel ratio was lean or, at step 640, it is judged that the previous result of judgement of the air-fuel ratio was rich, that is, if it is judged that the air-fuel ratio inverts from rich to lean or from lean to rich, the control proceeds to step 650 where an air-fuel ratio inversion flag Fλ showing that effect is set, then, at step 660, the mean value of the learned values of the model parameter R before and after the inversion, that is, $R_{NOW}$ and $R_{BF}$, is calculated as the true value $R_{CR}$ of the model parameter R, then at step 670 the current learned value $R_{NOW}$ is stored in the RAM 44 as $R_{BF}$ for the next processing, then the processing is ended once. The learned value $R_{BF}$ is stored in the backup area in the RAM 44 where the power is always supplied in the same way as the result of judgement of the air-fuel ratio.

If, at step 630, it is judged that the previous result of the judgement of the air-fuel ratio was rich or at step 640 that the previous result of judgement of the air-fuel ratio was lean, i.e., the air-fuel ratio inverted, the control proceeds to step 680, the air-fuel ratio inversion flag Fλ is reset, and the control proceeds to step 670.

Figures 8, 8A, 8B:
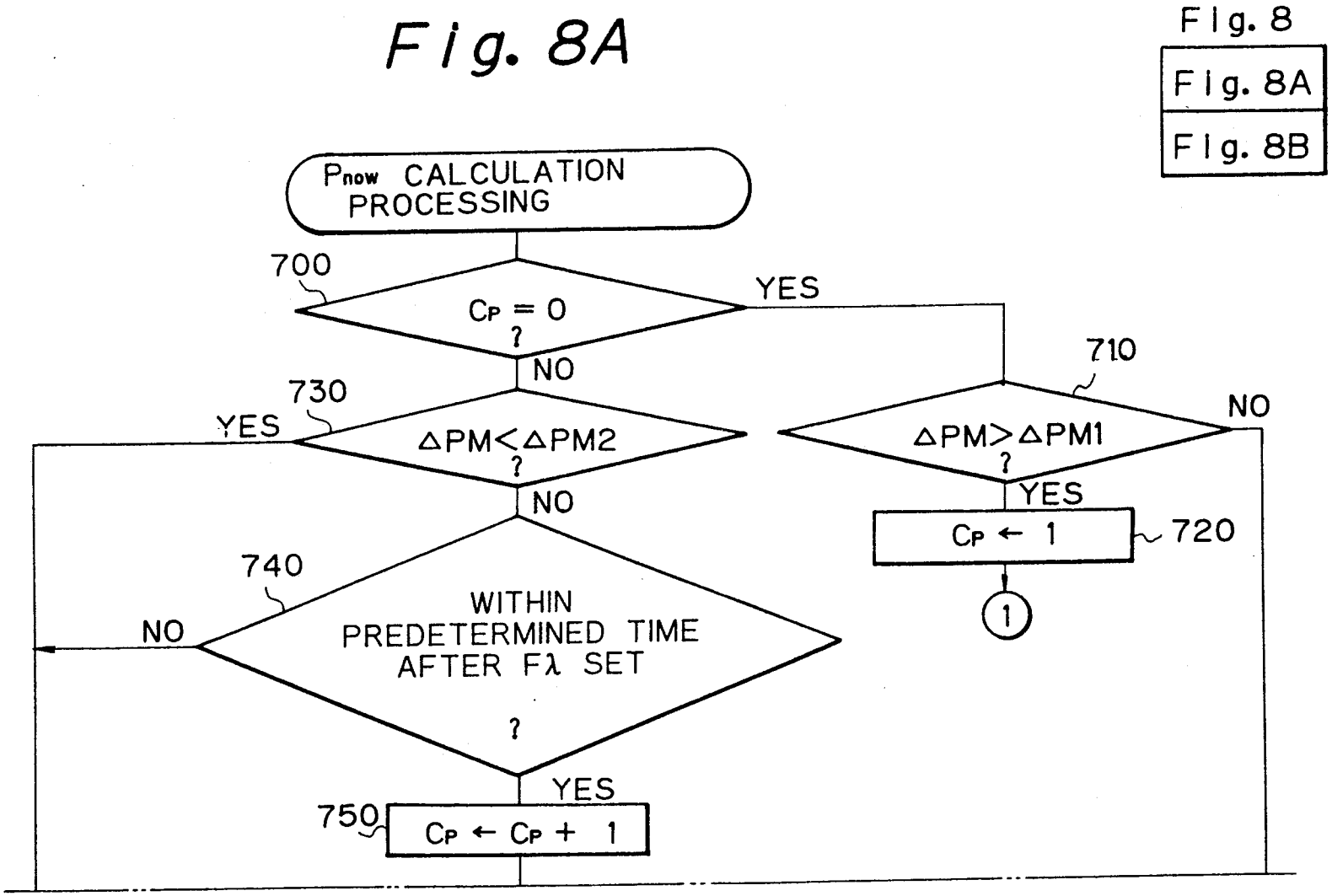
FIG. 8 is a flow chart showing a $P_{NOW}$ calculation processing executed every predetermined time by the electronic control circuit.
Figure 8B:
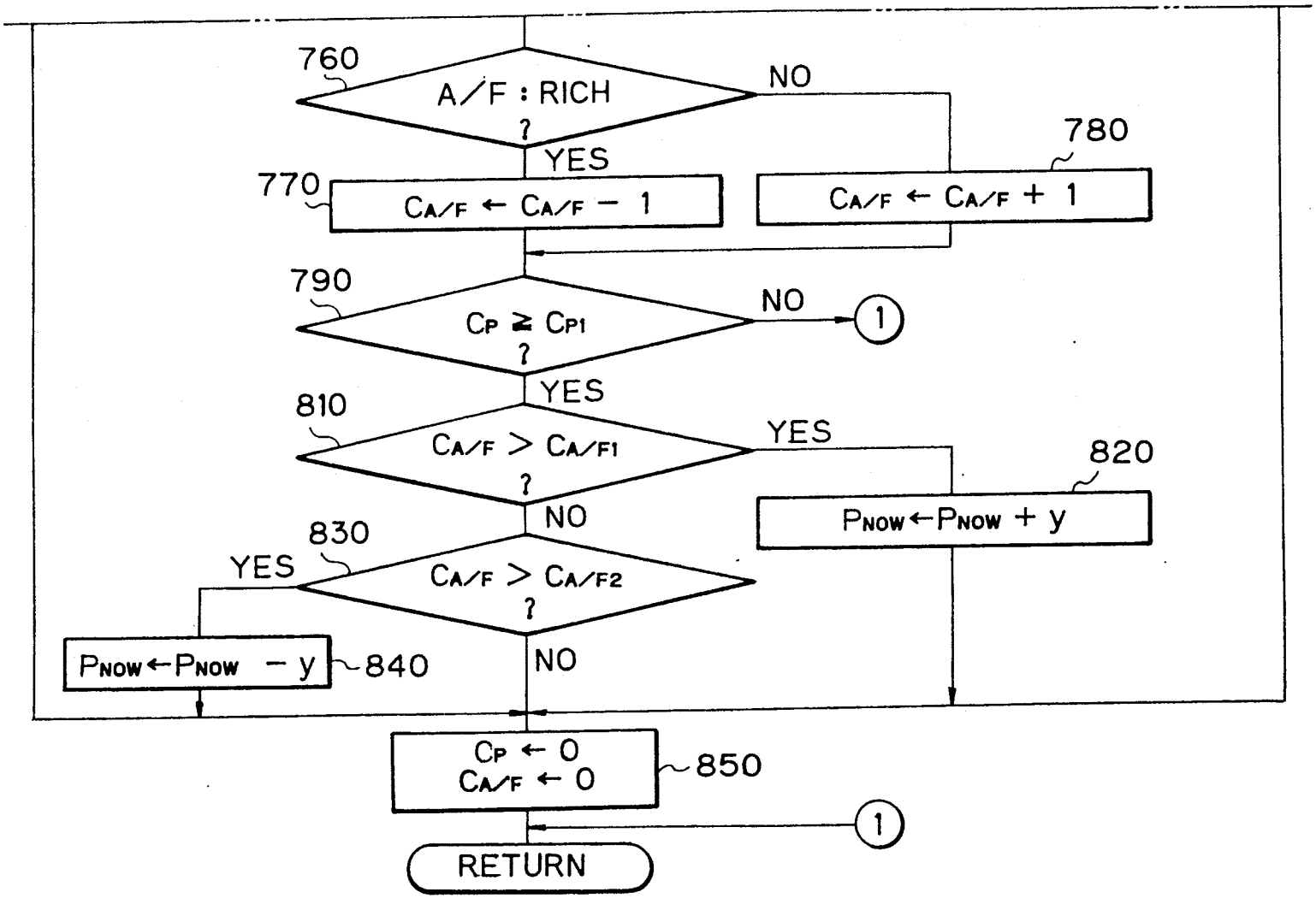

Next, FIG. 8 is a flow chart showing a $P_{NOW}$ calculation processing executed as interruption processing every predetermined time with respect to the main routine of FIG. 5 and realizing the above-mentioned acceleration judgement portion C16 of the model parameter calculation portion C0 and the $P_{NOW}$ calculation portion.

As illustrated, in the $P_{NOW}$ calculation processing, first control proceeds to step 700, where it is judged if the value of the counter Cp set to 1 at the time of acceleration of the internal combustion engine 2 is 0. If the counter Cp is 0, the control proceeds to step 710, where processing is executed as the acceleration judgement portion D1 for judging the acceleration operation of the internal combustion engine 2 by whether the error ΔPM between the current intake pipe pressure PM(n) and the intake pipe pressure PM(n−1) of the previous processing is over the predetermined value ΔPM1. If $\Delta PM \leqq \Delta PM1$, it is deemed that the internal combustion engine 2 is under acceleration, the control proceeds to step 850, where the processing is executed for initialization to make the counter Cp used for the processing and the value CA/F 0, whereupon the processing is once ended. Further, if $\Delta PM > \Delta PM1$ and it is judged at step 710 that the internal combustion engine 2 is accelerating, the control proceeds to step 720, 1 is set in the counter Cp, and the processing is once ended.

Next, at step 700, if it is judged that the value of the counter Cp is not 0, that is, if the internal combustion engine 2 enters acceleration operation, the control proceeds to step 730, then it is judged if the internal combustion engine 2 is in deceleration operation by whether the error ΔPM of the intake pipe pressure PM is smaller than a preset predetermined value ΔPM2 (negative value). Then, at step 730, if it is judged that the internal combustion engine 2 is in deceleration, the control proceeds as is to step 850, where the above-mentioned initialization processing is executed, then the processing is once ended.

On the other hand, at step 730, if it is judged that the internal combustion engine 2 is decelerating, the control proceeds to step 740, where it is judged if a predetermined time has elapsed after the setting of the air-fuel ratio inversion flag Fλ in the above-mentioned $R_{CR}$ calculation processing (that is, after the true value $R_{CR}$ of the model parameter R is calculated). If the predetermined time has elapsed after the setting of the air-fuel ratio inversion flag Fλ, step 850 is executed and the processing is once ended. If not, the control shifts to step 750, where the value of the counter Cp is incremented, then the control shifts to step 760.

At step 760, it is judged if the air-fuel ratio is rich based on the detection signals from the air-fuel ratio sensor 19. If the air-fuel ratio is rich, the control proceeds to step 770, where the value of the counter CA/F is decremented. Conversely, if the air-fuel ratio is lean, the control proceeds to step 780, where the value of the counter CA/F is incremented. The processing of steps 760 to 780 is for finding the error between the rich time and lean time of the air-fuel ratio after the internal combustion engine 2 once enters an acceleration operation. If the rich time of the air-fuel ratio is longer, the counter CA/F becomes a negative value and if the lean time of the air-fuel ratio is longer, the counter CA/F becomes a positive value.

Next, at step 790, it is judged if a predetermined time has elapsed after the start of the acceleration operation of the internal combustion engine 2 by whether the value of the counter Cp incremented in the step 750 is greater than a predetermined value Cp1. If Cp<Cp1 and the predetermined time has not elapsed after the start of the acceleration, the processing ends once, while if Cp≧Cp1 and the predetermined time has passed sine the start of the acceleration, the control proceeds to step 810, where it is judged if the value of the counter CA/F exceeds the preset predetermined value CA/F1. If CA/F>CA/F1, the lean time of the air-fuel ratio is too long, so the control proceeds to step 820, where the learned value $P_{NOW}$ is updated by adding a predetermined value y to the learned value $P_{NOW}$ of the model parameter P, then the control proceeds to step 850.

On the other hand, if CA/F≦CA/F1, the control shifts to step 830, where it is judged if the value of the counter CA/F is lower than a preset predetermined value CA/F2 (negative value). If CA/F<CA/F2, the rich time of the air-fuel ratio is too long, so the control shifts to step 840, where the learned value $P_{NOW}$ is updated by subtracting the predetermined value y from the learned value $P_{NOW}$ of the model parameter, then the control proceeds to step 850.

Further, if it is judged at step 830 that CA/F≧CA/F2, the lean time and the rich time of the air-fuel ratio are substantially equal and the air-fuel ratio control is being executed well, so the learned value $P_{NOW}$ is not updated and the control proceeds as is to the step 850.

Next, an explanation will be made, along with the flowcharts of FIG. 9 to FIG. 12, of the fuel injection control law executed by the electronic control circuit 30 in accordance with the control law in the case of use of the second method as the model parameter calculation portion.

Note that processing the same as in the case of use of the first method as the model parameter calculation portion is given the same step numbers and the following explanation is made of only different steps.

Figures 9, 9A:
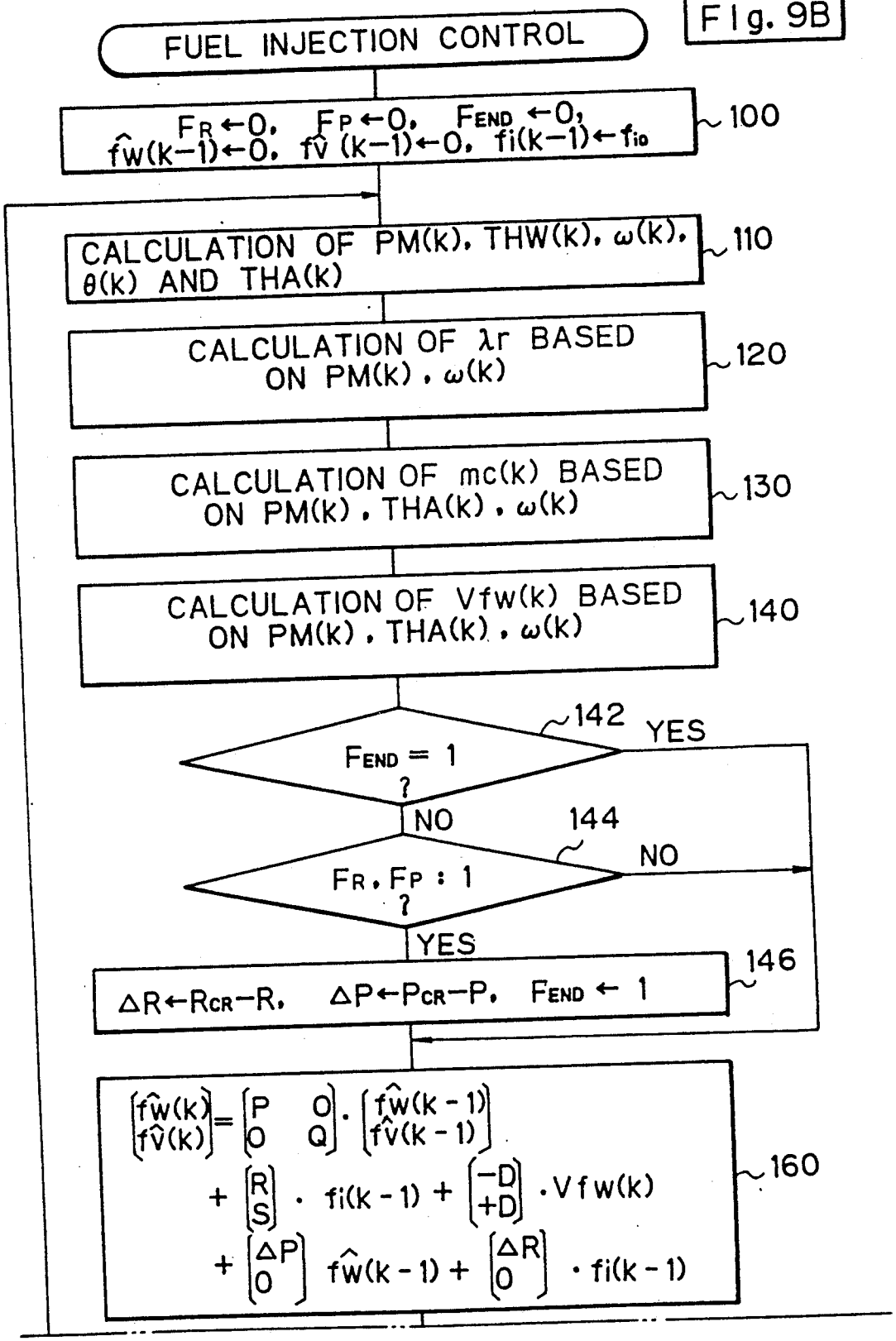
FIG. 9 is a flow chart showing a second embodiment of a main routine for fuel injection control executed by the electronic control circuit.
Figure 9B:
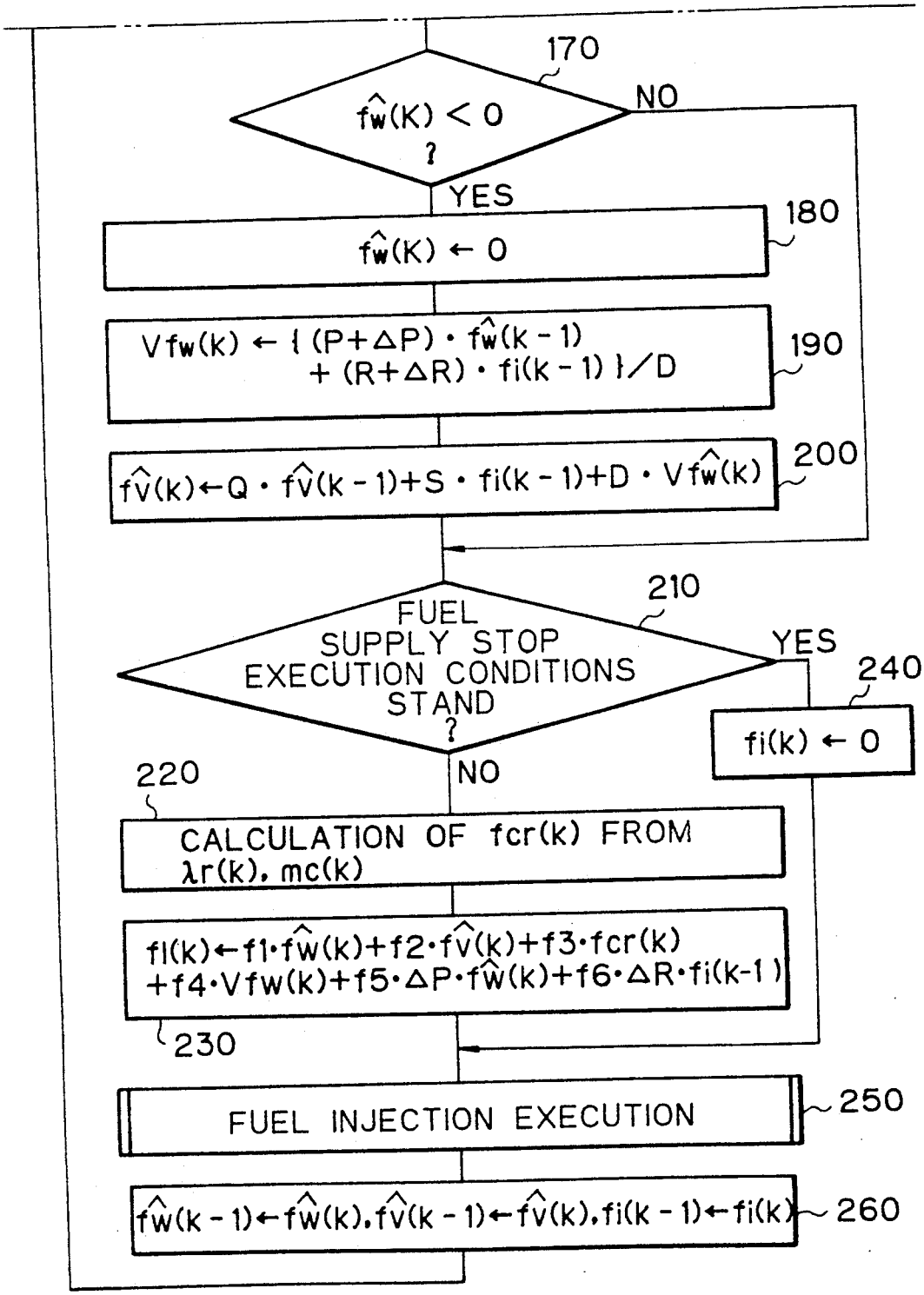

The processing from step 100 to step 140 in FIG. 9 is as explained previously.

Next, at step 142, it is judged if the flag $F_{END}$, set when calculating the errors ΔR and ΔP of the model parameters R and P at the next step 170, is set or not. If the flag $F_{END}$ is not set, then the control proceeds to step 144. At step 144, it is judged if the flags $F_R$ and $F_P$, set when the true values $R_{CR}$ and $P_{NOW}$ of the model parameters R and P were calculated by the later mentioned $R_{CR}$ calculation processing and $P_{CR}$ calculation processing. If both the flags $F_R$ and $F_P$ are set, the control proceeds to step 146, where processing is performed as the model error calculation portion A11 for calculating as the model error the errors ΔR and ΔP between the newest true values $R_{CR}$ and $P_{NOW}$ of the model parameters R and P calculated by the $R_{CR}$ calculation processing and the $P_{NOW}$ calculation processing and the model parameters P and R of the fuel dynamic model used when designing the control apparatus and setting the flag $F_{END}$ showing the fact of the calculation of the model errors ΔR and ΔP.

When the model errors ΔR and ΔP are calculated at step 146, when it is judged at step 142 that the flag $F_{END}$ has been set, or when it is judged at step 144 that either of the flags $F_R$ and $F_P$ is in the reset state, the control proceeds to step 160.

The processing from step 160 to step 260 is the same as explained previously.

Figures 10, 10A:
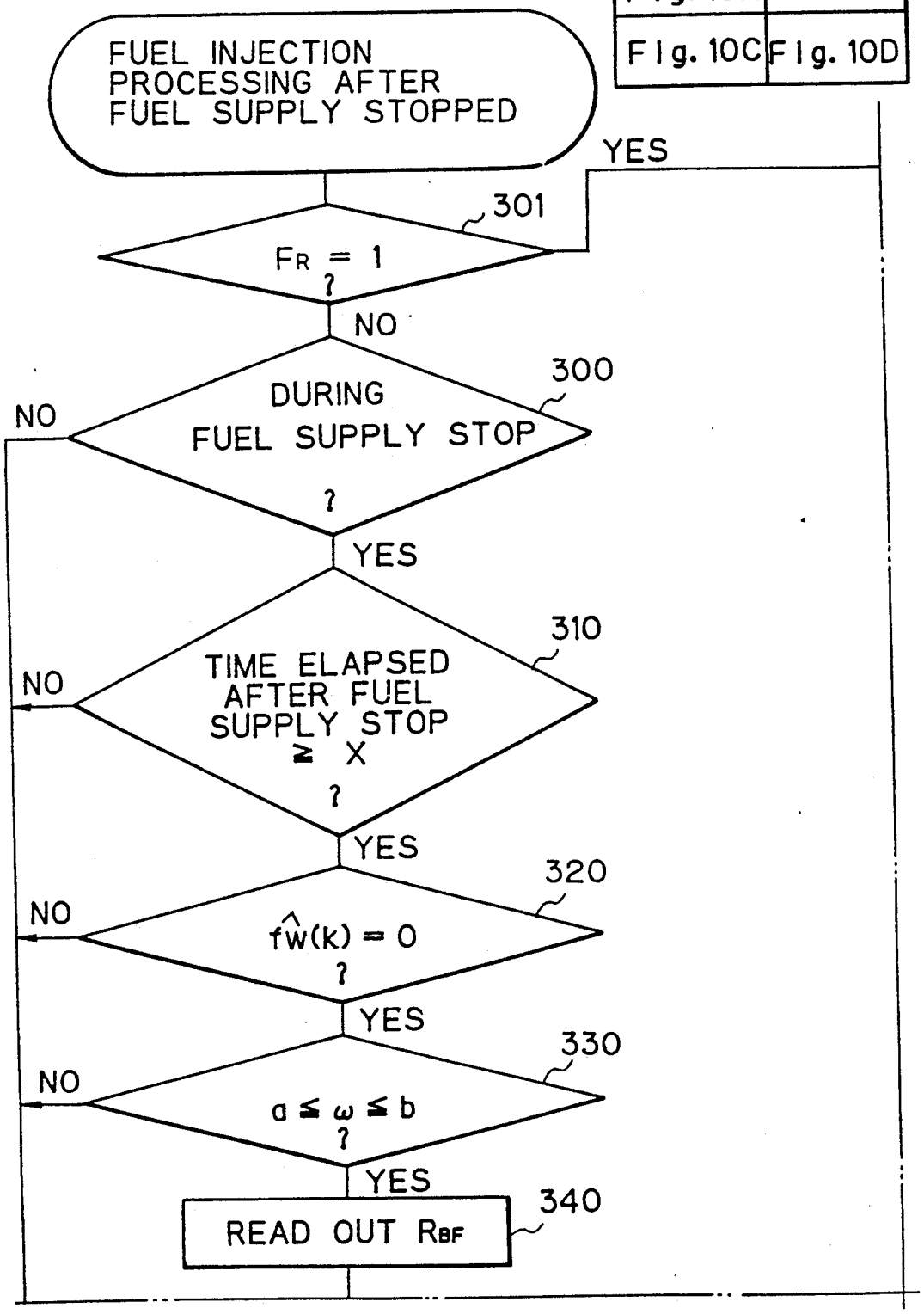
FIG. 10 is a flow chart showing fuel injection processing after fuel supply stopped executed each time the internal combustion engine rotates 30° CA by an electronic control circuit.
Figure 10B:
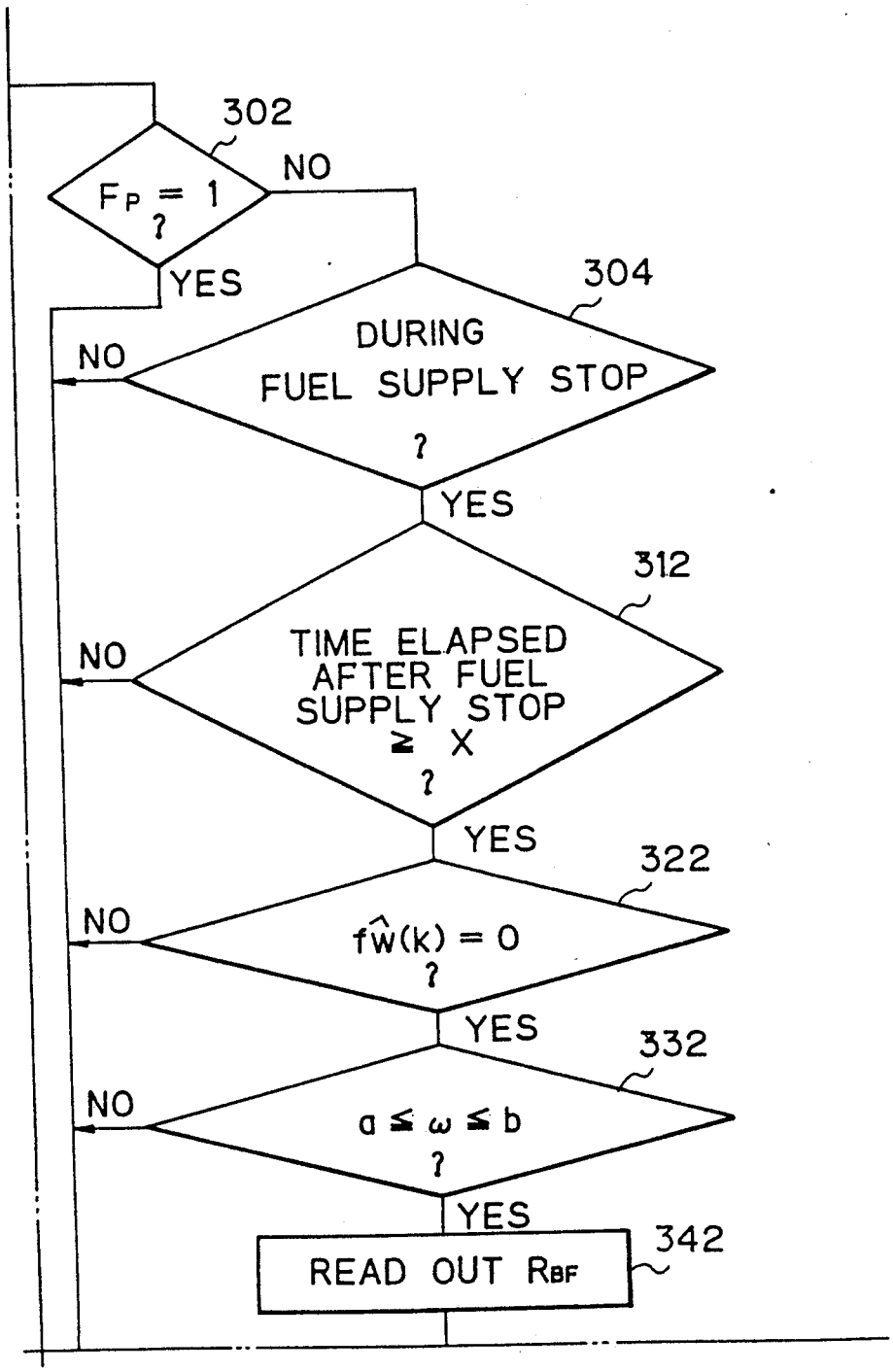
Figure 10C:
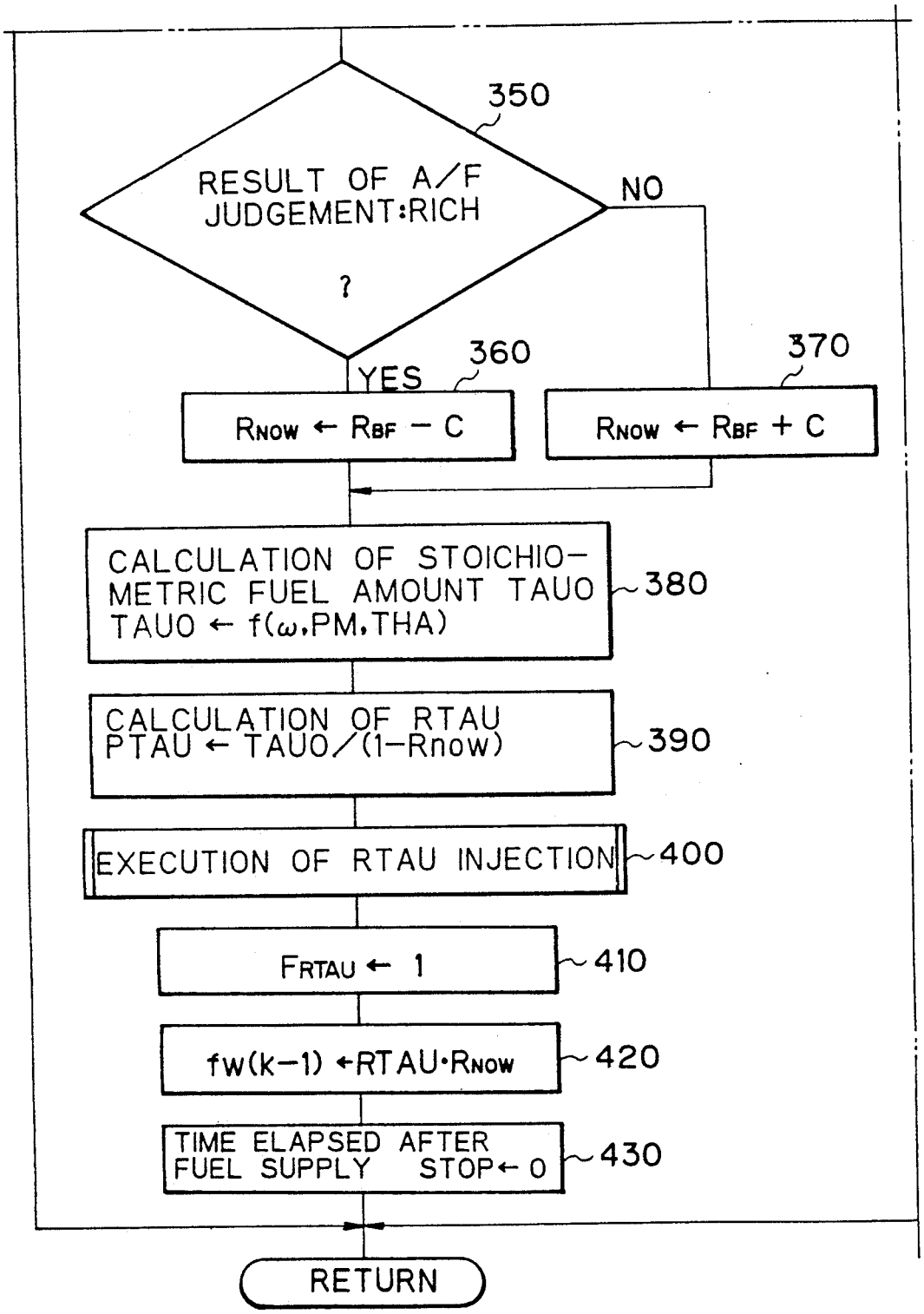
Figure 10D:
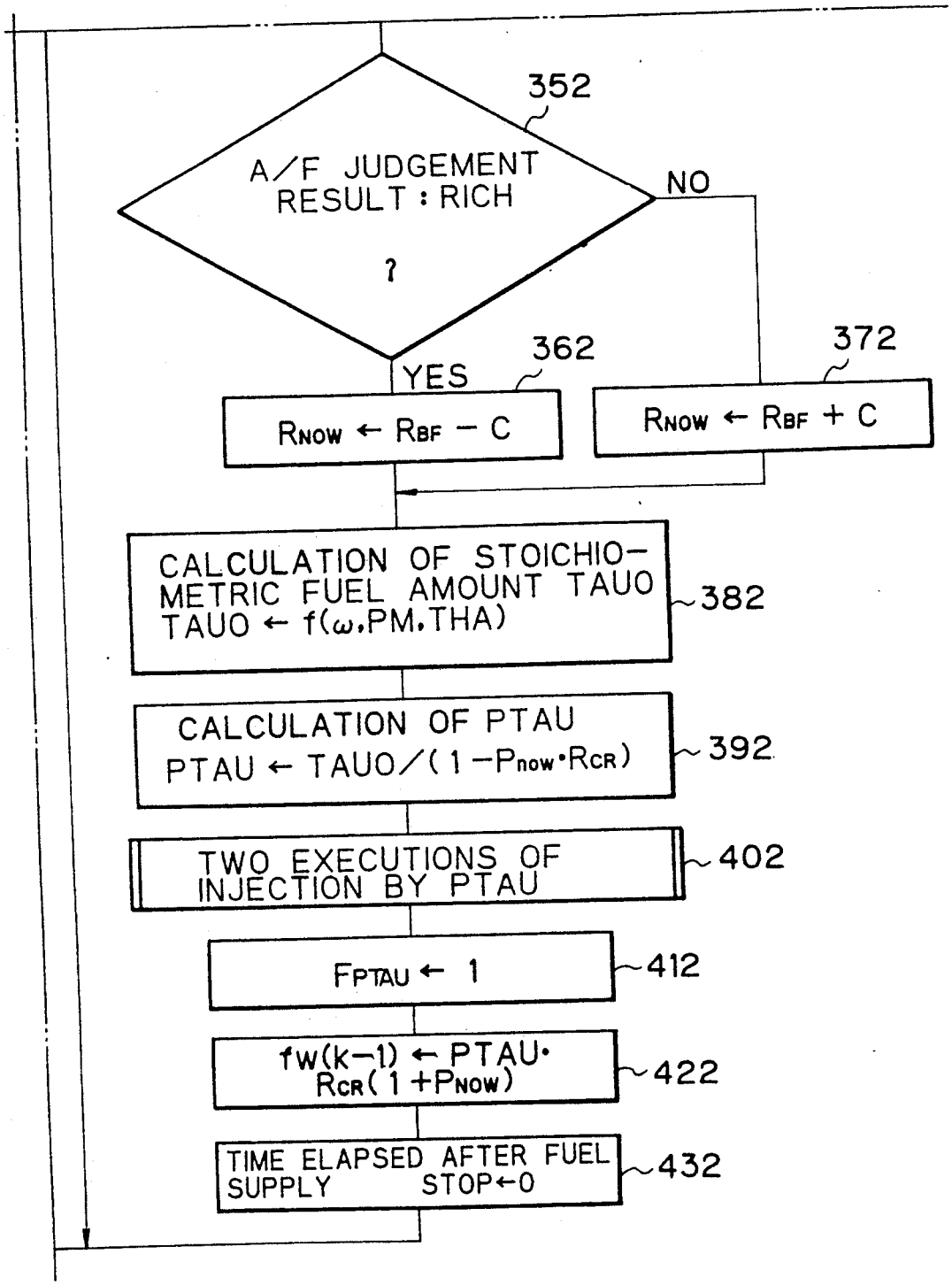

FIG. 10 is a flow chart showing a fuel supply stop fuel injection processing, for the main routine of FIG. 9, executed as interruption processing each time the internal combustion engine 2 rotates 30° CA. The fuel supply stop fuel injection processing realizes the stoichiometric injection amount calculation portion C21, the $R_{CR}$ calculation injection amount calculation portion C241, the $P_{CR}$ calculation injection amount calculation portion C251, the $R_{NOW}$ calculation portion C242, and the $P_{NOW}$ calculation portion C252 in FIG. 4.

As illustrated, in the fuel supply stop fuel injection processing, first, at step 301, it is judged if the flag $F_R$ set when the true value $R_{CR}$ of the model parameter R was calculated in the later mentioned $R_{CR}$ calculation processing is set.

When the flag $F_R$ is not set, the processing from step 300 on is performed. This processing was explained with reference to FIG. 6.

Next, if it is judged at step 301 that the flag $F_R$ is set, the control shifts to step 302, where it is judged if the flag $F_RP$, set when the true value $P_{CR}$ of the model parameter P was calculated in the later mentioned $P_R$ calculation processing, is set. If the flag $F_P$ is set, the processing ends as it is. If not, at steps 304 to 332, it is confirmed if there is fuel present in the intake pipe 4 by the fuel supply stop control in the same way as the processing of the above-mentioned steps 300 to 330.

If it is judged by the processing of steps 304 to 332 that there is no fuel present in the intake pipe 4, the control proceeds to the next step 342, where the previous learned value $P_{BF}$ of the model parameter P stored in the RAM 44 by the later mentioned $P_{CR}$ calculation processing is read out, then the control proceeds to step 352, where it is judged if the result of judgement of the air-fuel ratio stored in the RAM 44 in the previous $P_{CR}$ calculation processing was rich. If the result of judgement of the air-fuel ratio was rich, the value of the previous learned value $P_{BF}$ minus the predetermined value c is calculated as the learned value $P_{NOW}$ at step 362 and conversely if the result of the judgement of the air-fuel ratio is lean, the value of the previous learned value $P_{BF}$ plus the predetermined value c is calculated as the learned value $P_{NOW}$ at step 372.

If the learned value $P_{NOW}$ is calculated in this way, the control proceeds to step 382 where in the same way as with step 380, the stoichiometric fuel amount TAU0 is calculated based on the current operating condition (ω, PM, THA) of the internal combustion engine 2, then the control proceeds to step 392, where the second control law correction fuel injection amount, that is, the $P_{CR}$ calculation injection amount $P_{TAU}$, is calculated using the previous equation from the stoichiometric fuel amount TAU0 and the learned value $R_{NOW}$. At the next step 402, the fuel injector 32 is opened in accordance with the fuel injection amount $P_{TAU}$ at the fuel injection timing determined based on the detection signal from the crank angle sensor 24, whereby the second control law correction fuel injection is performed twice during the execution of the fuel supply stop control, then the control proceeds to step 412 where the fuel injection execution flag $F_{PTAU}$ showing this effect is set.

Next, at step 422, the amount of fuel $\hat{f}w(k-1)$ sticking to the walls of the intake pipe is calculated using the following equation based on the second control law correction fuel injection amount $P_{TAU}$ by which the current fuel injection is performed, the learned value $P_{NOW}$, and the true value $R_{CR}$ of the model parameter R:

$$\hat{f}w(k-1)=P_{TAU}\cdot R_{CR}(1+P_{NOW}) \quad (48)$$

so as not to allow error to be caused in the results of estimation of the amount of sticking fuel by the main routine of FIG. 10, then at step 432 the execution time of the fuel supply stop control is set to 0 and the processing is once ended.

Figure 11A:
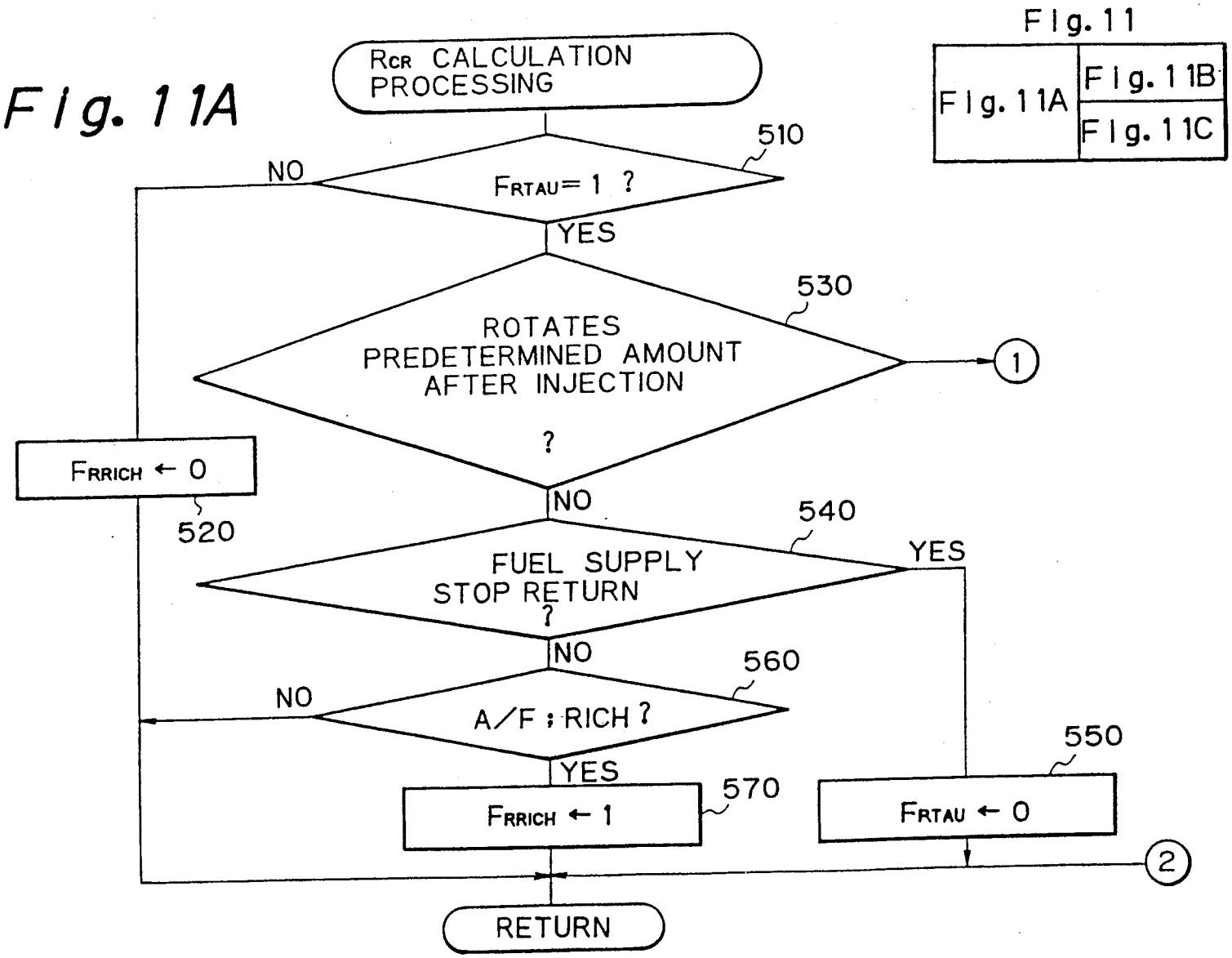
FIG. 11 is a flow chart showing the $R_{CR}$ calculation processing.
Figure 11B:
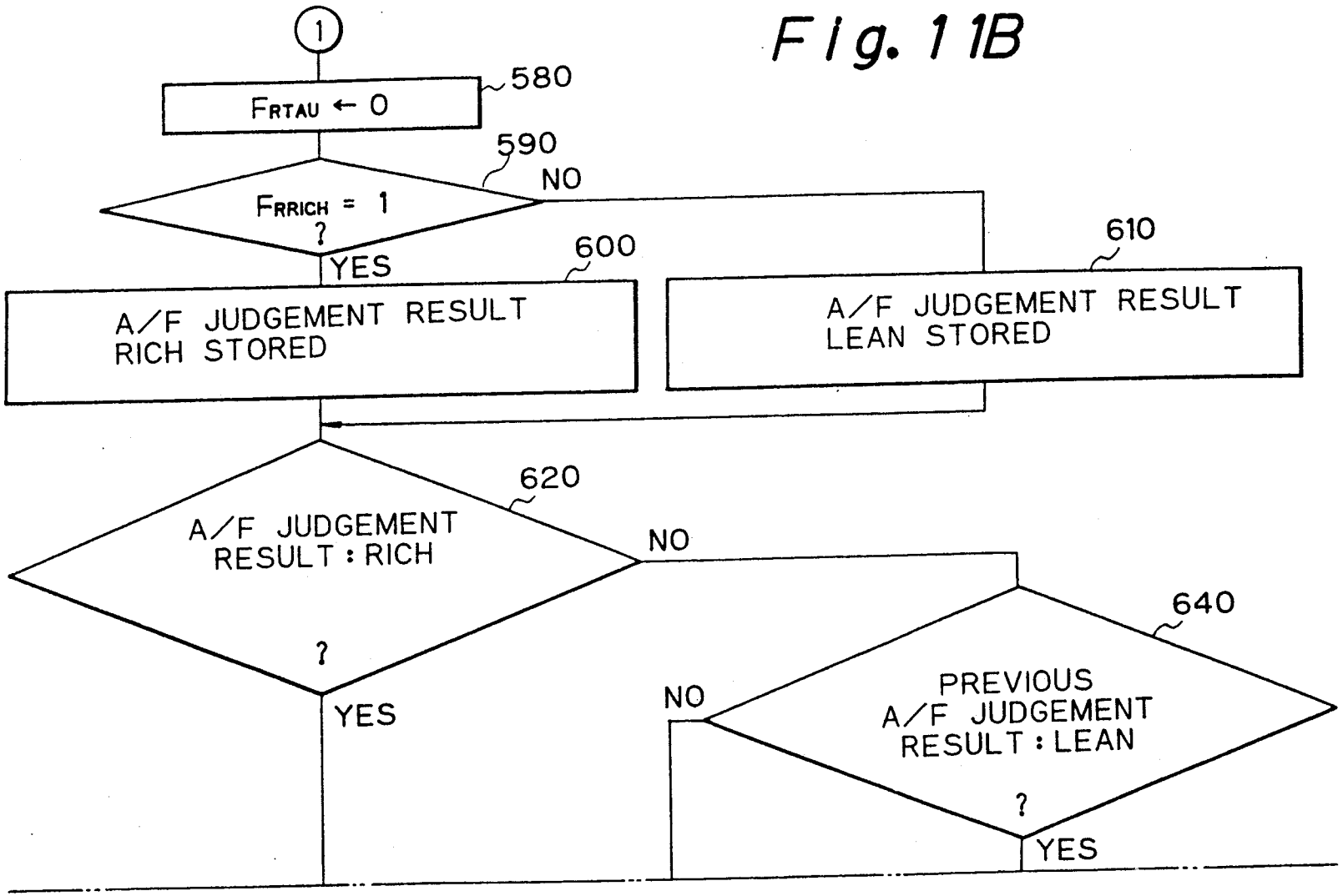
Figure 11C:
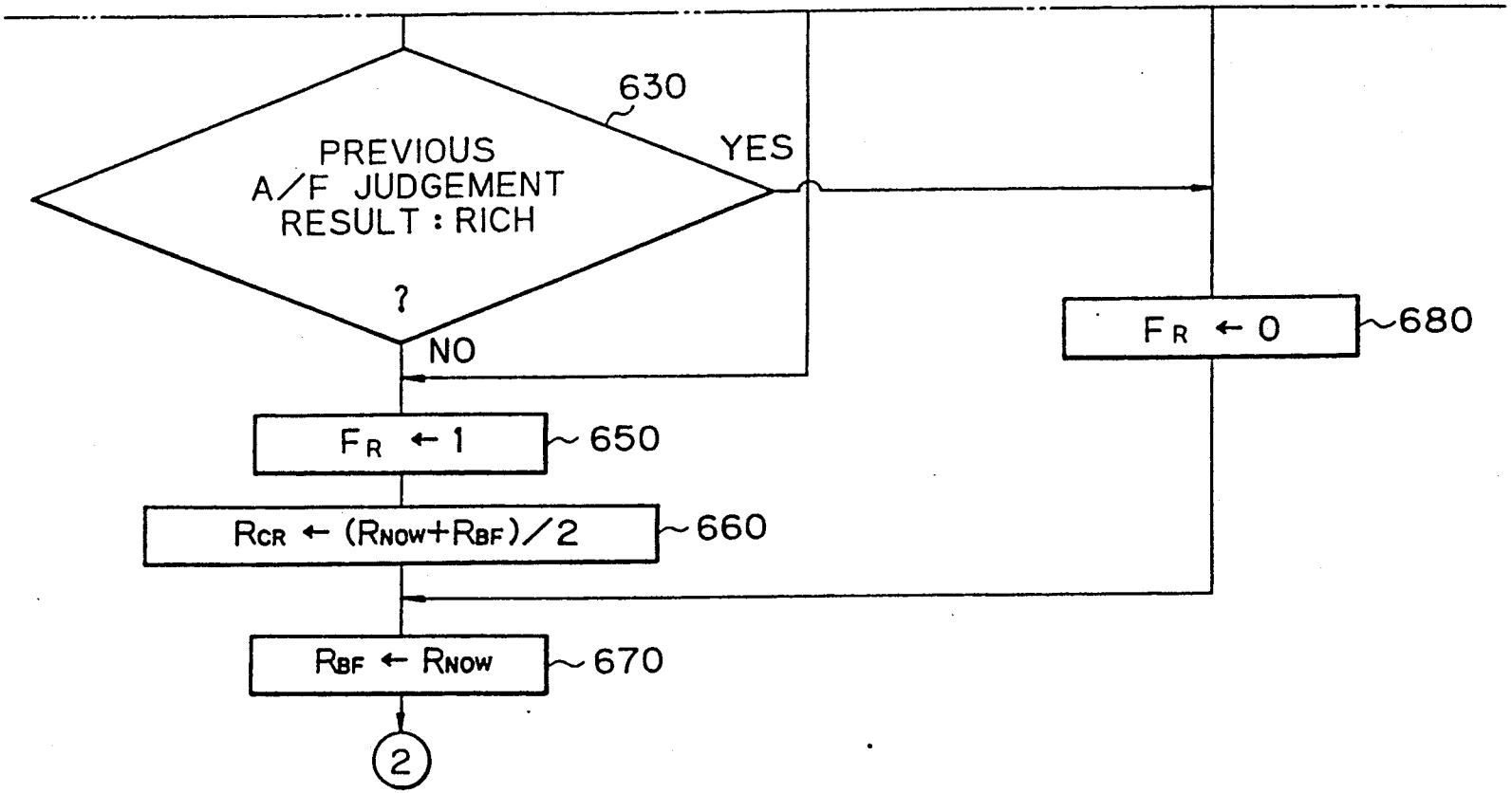

Next, FIG. 11 is a flow chart showing the $R_{CR}$ calculation processing executed with each 30° CA rotation of the internal combustion engine 2 in the same way as the fuel supply stop fuel injection processing of FIG. 10.

This processing is the same as the routine shown in FIG. 7 except that the variables $F_{TAU}$ and $F_{RICH}$ are changed to $F_{RTAU}$ and $F_{RRICH}$.

Figure 12A:
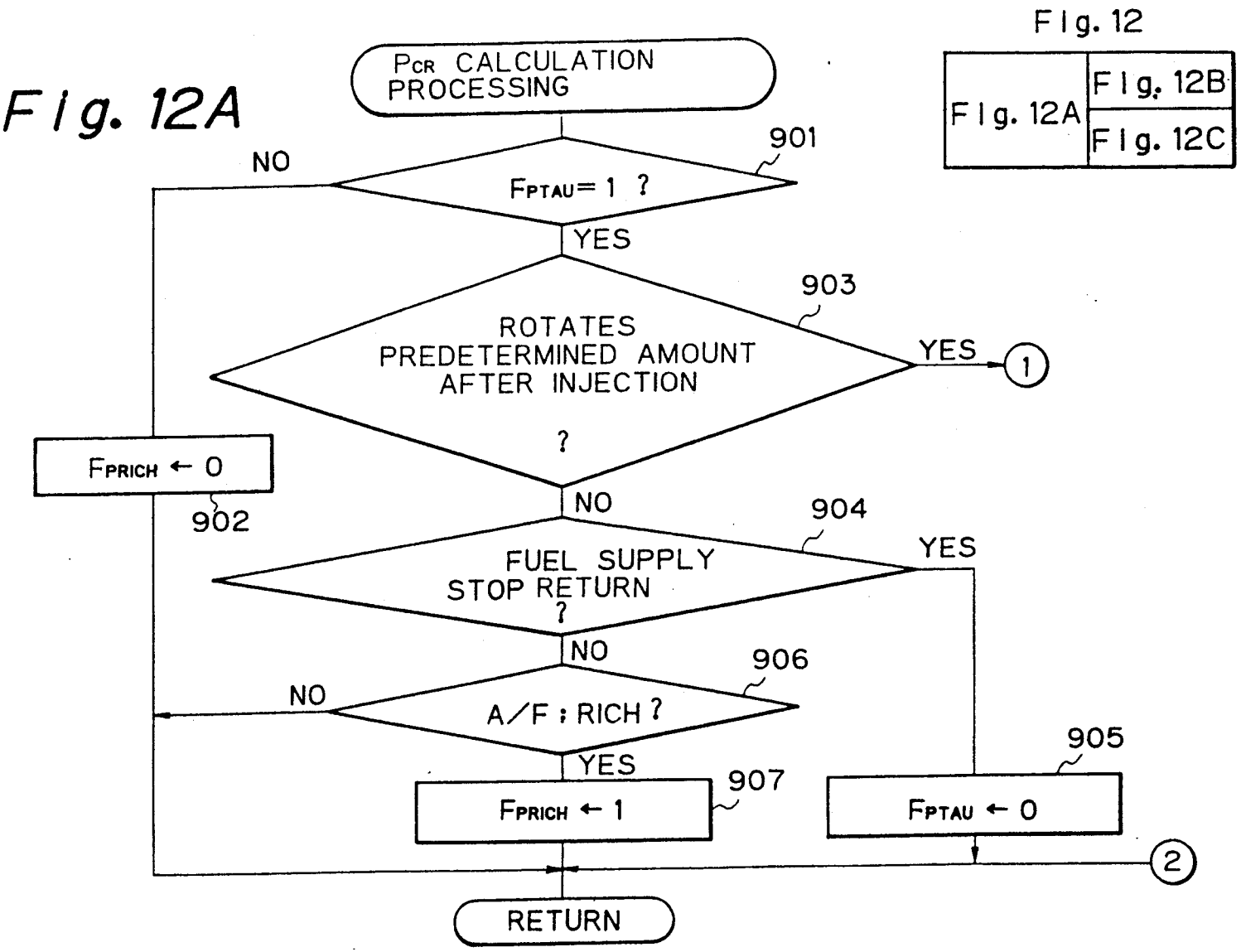
FIG. 12 is a flow chart showing a $P_{CR}$ calculation processing.
Figure 12B:
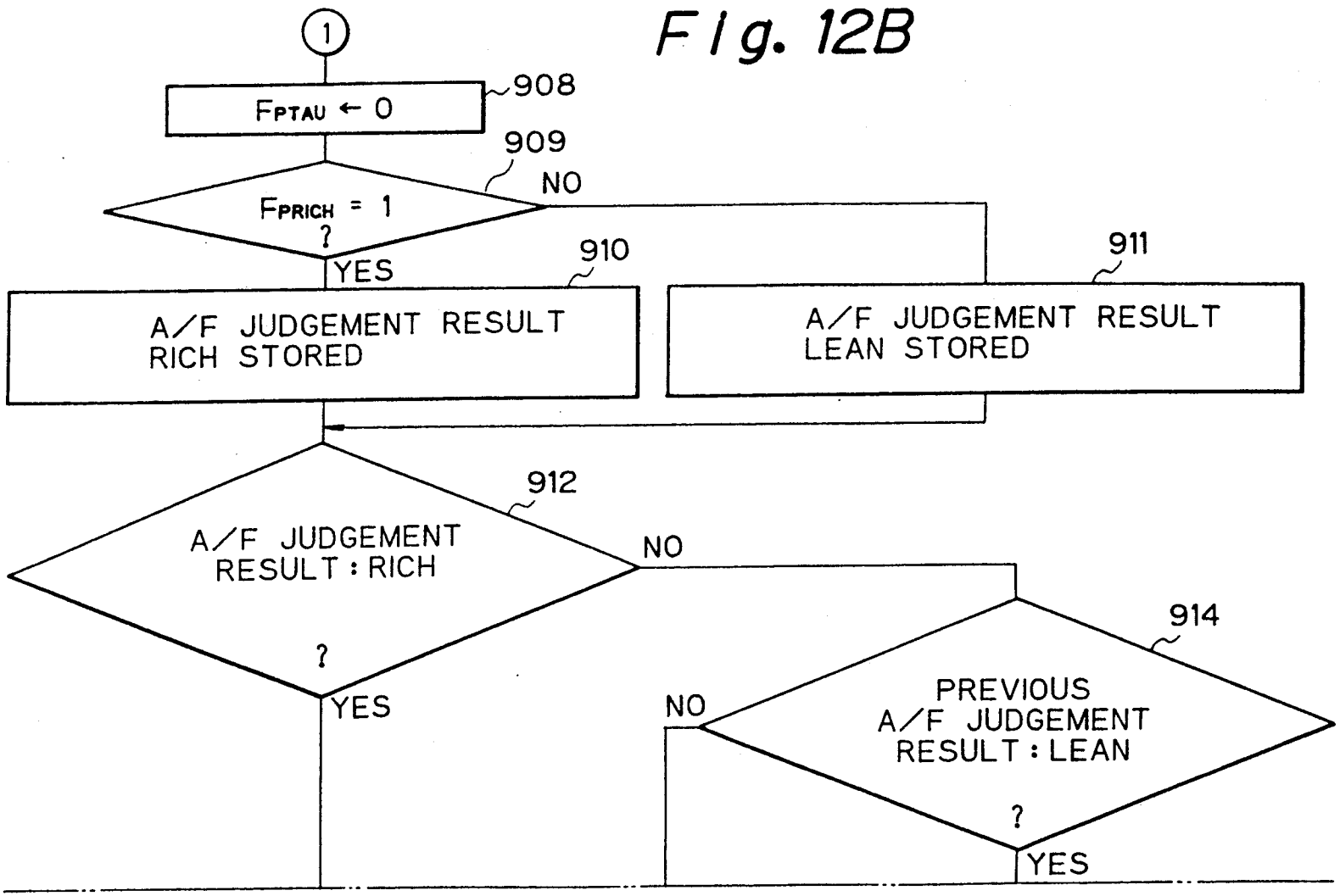
Figure 12C:
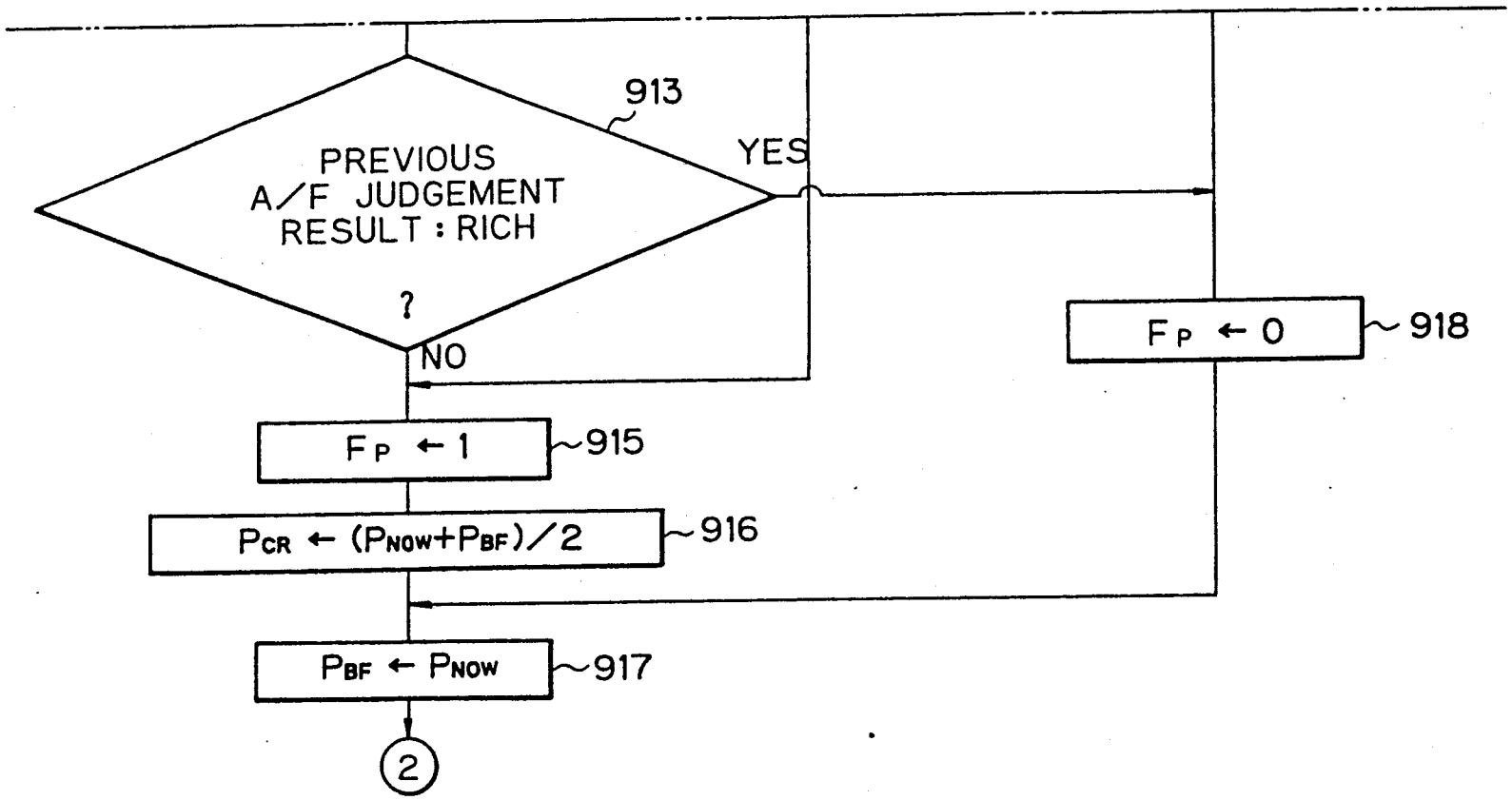

Next, FIG. 12 is a flow chart showing a $P_{CR}$ calculation processing executed with each 30° CA rotation of the internal combustion engine 2 in the same way as the above-mentioned $R_{CR}$ calculation processing and fuel supply stop fuel injection processing.

This processing is executed in the same way as the $R_{CR}$ calculation processing. First, at step 901, it is judged if the fuel injection execution flag $F_{PTAU}$, set when the $P_{CR}$ calculation second control law correction fuel injection was performed at the fuel supply stop fuel injection processing, is set or not. At step 902, if the fuel injection execution flag $F_{PTAU}$ is not set, the air-fuel ratio rich flag FPRICH used in the subsequent processing is reset and the processing is ended as is.

On the other hand, at step 901, if it is judged that the fuel injection execution flag $F_{PTAU}$ is set, then the control proceeds to step 903, where it is judged if the internal combustion engine 2 has rotated a predetermined amount, in the same way as with step 30. If the internal combustion engine 2 has not rotated the predetermined amount, the control proceeds to step 904, where it is judged if the operating state of the internal combustion engine 2 has returned from the fuel supply stop control to the usual fuel injection control. If it has returned to the fuel supply stop control, then at step 905, the fuel injection execution flag $F_{PTAU}$ is reset, and the processing once ended. Conversely, if it has not returned from the fuel supply stop control, the control proceeds to step 906. At step 906, it is judged if the current air-fuel ratio is rich based on the detection signals from the air-fuel ratio sensor 19. If the air-fuel ratio is rich, the control proceeds to step 907, where the air-fuel ratio rich flag FPRICH is set. If the air-fuel ratio is lean, the processing ends as is.

Next, if it is judged at step 903 that the internal combustion engine 2 has rotated a predetermined amount after the control law correction fuel injection, the control proceeds to step 908, where the fuel injection execution flag $F_{PTAU}$ is reset. Next, at step 909, it is judged if the air-fuel ratio after the fuel injection has become rich by whether the air-fuel ratio rich flag FPRICH is set. If the air-fuel ratio is rich, at step 910, the data showing the richness of the air-fuel ratio is stored in the RAM 44 as the result of judgement of the air-fuel ratio after fuel injection. If not, then at step 911 the data showing the leanness of the air-fuel ratio is stored in the RAM 44 as the result of judgement of the air-fuel ratio.

At the next step 912, it is judged if the result of judgement of the air-fuel ratio was rich. If the result of judgement of the air-fuel ratio was rich, the control proceeds to step 913, where it is judged if the previous result of judgement of the air-fuel ratio was also rich. If at step 912 it is judged that the result of judgement of the air-fuel ratio was lean, the control proceeds to step 914 and it is judged if the previous result of judgement of the air-fuel ratio was also lean.

If at step 913 it is judged that the previous result of judgement of the air-fuel ratio was lean or at step 914 it is judged that the previous result of judgement of the air-fuel ratio was rich, that is, if it is judged that the air-fuel ratio has inverted from rich to lean or from lean to rich, the control proceeds to step 915, where the flag $F_P$ is set, then at step 916, the mean value of the learned values of the model parameter P before and after the inversion, that is, $P_{NOW}$ and PBR, is calculated as the true value $P_{CR}$ of the model parameter $P_{CR}$, then at step 917, the current learned value $P_{NOW}$ is stored in the RAM 44 as $P_{BF}$ for the next processing, then the processing is once ended.

If at step 913 it was judged that the previous result of judgement of the air-fuel ratio was rich, or at step 914 it was judged that the previous result of judgement of the air-fuel ratio was lean, that is, the air-fuel ratio has not inverted, the flag $F_P$ is reset at step 918 and the control proceeds to step 917.

As explained in detail above, in the first embodiment, during execution of fuel supply stop control where the fuel in the intake pipe disappears, fuel injection is performed by the control law correction fuel injection amount TAU calculated using the model parameter R (specifically the learned value $R_{NOW}$) showing the rate of sticking of the injected fuel to the walls so that the air-fuel mixture flowing into the cylinder 2a becomes the stoichiometric air-fuel ratio. The learned value $R_{NOW}$ of the model parameter R is updated from the state of the air-fuel ratio at that time. When the air-fuel ratio of that time inverts from lean to rich or from rich to lean, the learned values $R_{BF}$ and $R_{NOW}$ before and after that are the closest to the actual fuel dynamics and the mean value of the learned values $R_{BF}$ and $R_{NOW}$ is calculated as the true value $R_{CR}$ of the model parameter R. Therefore, the true value $R_{CR}$ of the model parameter R is not affected by the error of the other model parameters showing the dynamics of the fuel sticking to the walls, in particular the model parameter P which is susceptible to the fuel characteristics, and becomes the value showing the true model parameter R, this enable good prevention of control error caused by error of the model parameter R.

Further, in this embodiment, if the internal combustion engine 2 accelerates before the elapse of a predetermined period after the true value $R_{CR}$ of the model parameter R is calculated, the error of the learn/rich times of the air-fuel ratio in the period after the elapse of a predetermined time is found and if that error is large, it is deemed that error has occurred in the model parameter P and the learned value $P_{NOW}$ is updated. Therefore, even if the model parameter P changes due to differences in the fuel characteristics, it is possible to compensate for control error caused by this. Further, even if error occurs in model parameters other than the model parameter R and control error occurs, the control error is absorbed as the error of the model parameter P and the control accuracy can be improved by this as well.

Further, in the second embodiment, during execution of the fuel supply stop control, first, a single fuel injection is performed by the first control law correction fuel injection, i.e., the $R_{CR}$ calculation injection amount $R_{TAU}$, using the learned value $R_{NOW}$ of the model parameter R so that the air-fuel mixture flowing into the cylinder 2a becomes the stoichiometric air-fuel ratio. The learned value $R_{NOW}$ of the model parameter R is updated from the state of the air-fuel ratio at that time. Further, when the air-fuel ratio of that time inverts from lean to rich or from rich to lean, the learned values $R_{BF}$ and $R_{NOW}$ before and after that are considered closest to the actual fuel dynamics and the mean value of the learned values $R_{BF}$ and $R_{NOW}$ is calculated as the true value $R_{CR}$ of the model parameter R. Next, two fuel injections are performed by the second control law correction fuel injection amount, i.e., the $P_{CR}$ calculation injection amount $P_{TAU}$, using the above calculated true value $R_{CR}$ of the model parameter R and the learned value $R_{NOW}$ of the model parameter R so that the air-fuel mixture flowing into the cylinder 2a becomes the stoichiometric air-fuel ratio. The learned value $P_{NOW}$ of the model parameter P is updated from the state of the air-fuel ratio at that time. Further, when the air-fuel ratio at that time inverts from lean to rich or from rich to lean, the learned values $P_{BF}$ and $P_{NOW}$ before and after that are considered closest to the actual fuel dynamics and the mean value of the learned values $P_{BF}$ and $P_{NOW}$ is calculated as the true value $P_{CR}$ of the model parameter P. Therefore, the it is possible to calculate accurately and with a high frequency the true values $R_{CR}$ and $P_{CR}$ of the model parameters R and P and it is possible to prevent well control error occurring due to the error of the model parameters R and P using the thus calculated true values $R_{CR}$ and $P_{CR}$.

In the above embodiments, the explanation was made of a control system grasping the internal combustion engine 2 as having one cylinder, determining the control law based on the fuel dynamics, and executing fuel injection amount control. In the case of a multicylinder internal combustion engine, it is possible to realize the invention by providing air-fuel ratio sensor directly after the exhaust valve of the cylinders, detecting the air-fuel ratio for each cylinder, and executing the above control for each cylinder.

Further, in the case of multicylinder internal combustion engine, it may be considered to estimate the amount of stacking fuel fw, the amount of evaporated fuel fv, etc. for a specific cylinder and to execute the fuel injection control for the cylinders in accordance with the results of the calculation. In this case, the air-fuel ratio sensor may be provided directly after the exhaust valve of the specific cylinder, the model parameter R or R and P learned in accordance with the results of detection of the air-fuel ratio by the sensor, and the control law thus corrected.

Further, in the case of a multicylinder internal combustion engine, sometimes a single air-fuel ratio sensor is provided at the convergence portion of the exhaust passages of the cylinders. In this case, the fuel injection at the time of the fuel supply stop may be performed for all the cylinders and the air-fuel ratio caused by the same detected so as to learn the model parameter R or R and P.

Figure 13:
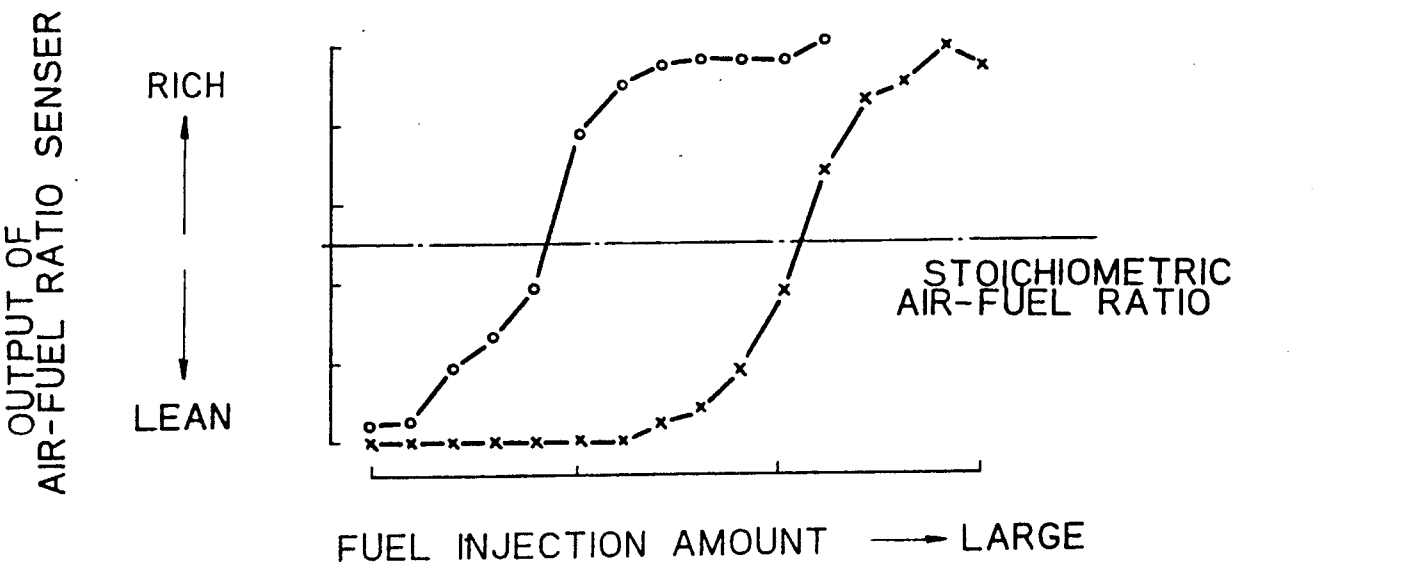
FIG. 13 is a graph showing the relationship between the sensor output and fuel injection amount in the case of an air-fuel ratio sensor mounted directly after the exhaust valve and the case of it mounted on the convergence portion of the exhaust passages.

Further, in the first embodiment, when such an air-fuel ratio sensor is provided at the convergence portion of the exhaust passages of the cylinders, fuel exists at the convergence portion of the exhaust passages, so as shown by the graph of the air-fuel ratio sensor output and the fuel injection amount of FIG. 13, detection of the stoichiometric air-fuel ratio by the air-fuel ratio sensor requires that the fuel injection amount be made somewhat greater than the case with provision of the air-fuel ratio sensor directly after the exhaust valves so as to make the air-fuel ratio of the air-fuel mixture flowing into the cylinder 2a richer. The learned value $R_{NOW}$ of the model parameter R updated by this control ends up larger than the actual fuel dynamics. However, the difference between the output of the air-fuel ratio sensor at the convergence portion of the exhaust passages and the output of the air-fuel ratio just after the exhaust valve deviates on a mean basis, so by subtracting from the mean value of the learned values $(=(R_{NOW}+R_{BF})/2)$ a predetermined value based on the error of the sensor output and calculating the true value $R_{CR}$ of the model parameter R in this way, it is possible to accurately find the true value $R_{CR}$ of the model parameter R. Further, in this case, the learned value $R_{NOW}$ of the model parameter R becomes larger than the actual fuel dynamics, so when calculating the amount of fuel $\hat{fw}(k-1)$ sticking to the walls of the intake pipe at step 420, it is desirable to multiply the value found by equation (47) by a predetermined coefficient less than 1 or to subtract a predetermined amount so as to correct the same.

Further, in the above embodiment, the error was found for not only the model parameter R showing the rate of sticking of the injected fuel to the walls of the intake pipe, but also the model parameter P showing the rate of remainder of the fuel sticking to the walls and the control law corrected accordingly, but of course it is possible to correct the control law by finding the error only for the model parameter R and still improve the control accuracy of the air-fuel ratio from the prior art.

Further, in the above embodiment, as the air-fuel ratio sensor, use was made of a sensor detecting the lean and rich states of the air-fuel ratio, so the fuel injection amount TAU during execution of the fuel supply stop control is controlled so that the air-fuel ratio of the air-fuel mixture flowing into the cylinder becomes the stoichiometric air-fuel ratio and the learned value $R_{NOW}$ of the model parameter R calculated based on this, but in the case of use of an air-fuel ratio sensor which can detect the entire region of the air-fuel ratio, it is possible to make the fuel injection amount TAU a fixed amount, perform the fuel injection during execution of the fuel supply stop control, calculate the air-fuel ratio from the amount of cylinder air flow mc at that time and the learned value $R_{NOW}$ of the model parameter R, update the learned value $R_{NOW}$ in accordance with the error between the results of calculation and the results of detection of the air-fuel ratio, and use the learned value $R_{NOW}$ as is as the true value of the model parameter R.

Further, in the second embodiment, the true values $R_{CR}$ and $P_{CR}$ of the model parameters R and P are found by injecting the fuel once or twice during the execution of the fuel supply stop control, but the amount of air becomes lower and the combustion tends to become unstable during execution of fuel supply stop control, so it is possible to open up the idle speed control valve (ISCV) provided in the intake system of the internal combustion engine for control of the rotational speed of the internal combustion engine during idling so as to increase the amount of air or, when a shock occurs in the vehicle due to the fuel injection, to perform delay control of the ignition timing so as to prevent shocks.

Although the invention has been described with reference to specific embodiments chosen for purposes of illustration, it should be apparent that numerous modifications could be made thereto by those skilled in the art without departing from the basic concept and scope of the invention.

I claim:

1. A fuel injection control apparatus of an internal combustion engine having an intake passage, comprising:

a fuel injector for injecting fuel in the intake passage;

fuel injection amount calculation means for calculating the regular fuel injection amount to be injected from the fuel injector based on a control law determined in accordance with a fuel dynamic model expressing the dynamics of the fuel flowing into a cylinder of the engine;

fuel injection stopping means for stopping the regular fuel injection based on the calculation by said regular fuel injection amount calculation means;

control law correction fuel injection means for performing control law correction injection during the stoppage of the regular fuel injection;

fuel sticking rate calculation means for calculating the rate of sticking of the control law correction injected fuel to the walls of the intake passage based on the amount of control law correction fuel injected during the stoppage of the regular fuel injection, amount of air flowing into the cylinder, and the air-fuel ratio of the air-fuel mixture flowing into the cylinder; and correction means for correcting the control law with respect to the amount of injected fuel to be supplied to the engine and making the air-fuel ratio a predetermined air-fuel ratio based on the calculated rate of sticking of fuel.

2. A fuel injection control apparatus as set forth in claim 1, wherein the fuel dynamic model uses as the state variables the amount of fuel sticking to the walls of the intake passage and the amount of evaporated fuel in the intake passage.

3. A fuel injection control apparatus as set forth in claim 1, wherein the fuel dynamic model may be expressed by the following equation:

$$\begin{bmatrix} \hat{fw}(k+1) \\ \hat{fv}(k+1) \end{bmatrix} = \begin{bmatrix} PO \\ OQ \end{bmatrix} \cdot \begin{bmatrix} \hat{fw}(k) \\ \hat{fv}(k) \end{bmatrix} + \begin{bmatrix} R \\ S \end{bmatrix} \cdot fi(k) + \begin{bmatrix} -D \\ +D \end{bmatrix} \cdot Vfw(k) \quad (1)$$

$$fc(k) = [1 - P1 - Q] \begin{bmatrix} \hat{fw}(k) \\ \hat{fv}(k) \end{bmatrix} + (1 - R - S)fi(k) - \Delta P \cdot \hat{fw}(k) - \Delta R \cdot fi(k)$$

where, fw is the amount of fuel sticking to the walls of the intake passage, fv is the amount of fuel vaporizing in the intake passage, fi is the amount of fuel injected, Vfw is the amount of fuel evaporating from the walls of the intake passage, fc is the amount of fuel flowing into the cylinder, P is the model parameter of the rate of remainder of sticking fuel at the time of design, ΔP is the error between the model parameter of the rate of remainder of the sticking fuel at the time of design and the true value, R is the model parameter of the rate of sticking to the walls at the time of design; ΔR is the error between the model parameter of the rate of sticking to the walls at the time of design and the learned value, and Q, S, and D are constants.

4. A fuel injection control apparatus as set forth in claim 1, wherein the control law is calculated by an optimum regulator of the fuel dynamic model.

5. A fuel injection control apparatus as set forth in claim 1, which is provided with deceleration operation detection means for detecting the deceleration operation of the engine, the fuel injection stopping means stopping the regular fuel injection when the deceleration operation detection means detects deceleration operation.

6. A fuel injection control apparatus as set forth in claim 5, wherein the deceleration operation detection means judges that the state is of a deceleration operation when a throttle valve is in an idling position and the engine rotational speed is higher than a predetermined rotational speed.

7. A fuel injection control apparatus as set forth in claim 1, wherein the control law correction fuel injection means performs the control law correction fuel injection after the fuel sticking to the walls of the intake passage disappears.

8. A fuel injection control apparatus as set forth in claim 1, wherein the control law correction fuel injection means performs the control law correction fuel injection after the elapse of a predetermined time from the stopping of the regular fuel injection.

9. A fuel injection control apparatus as set forth in claim 1, wherein the control law correction fuel injection means performs the control law correction fuel injection repeatedly at predetermined time intervals.

10. A fuel injection control apparatus as set forth in claim 9, wherein when the air-fuel ratio after the previous control law correction fuel injection is rich, the learned value of the rate of fuel sticking to the walls of the intake passage at the time of execution of the previous control law correction fuel injection is decreased and when the air-fuel ratio is lean, learned value of the fuel sticking rate is increased, thereby determining the learned value of the current fuel sticking rate.

11. A fuel injection control apparatus as set forth in claim 10, wherein the control law correction fuel injection amount is determined by the following equation:

$$TAU = TAU0/(1 - R_{NOW})$$

where, TAU0 is the amount of fuel for making the air-fuel ratio the stoichiometric air-fuel ratio and $R_{NOW}$ is the learned value of the rate of fuel sticking to the walls of the intake passage used for the current control law correction fuel injection.

12. A fuel injection control apparatus as set forth in claim 11, wherein the amount of fuel sticking to the walls of the intake passage due to the control law correction fuel injection is expressed as the product of the control law correction fuel injection amount and the learned value of the rate of fuel sticking to the walls of the intake passage currently.

13. A fuel injection control apparatus as set forth in claim 10, wherein when the air-fuel ratio inverts due to the execution of the control law correction fuel injection, the true value of the rate of sticking of fuel to the walls of the intake passage is calculated as the arithmetical mean value of the learned values of the rate of sticking of fuel before and after the inversion of the air-fuel ratio.

14. A fuel injection control apparatus as set forth in claim 13, which is provided with acceleration operation state detection means which detects an acceleration operation state of an engine, the learned value of the rate of remainder of sticking fuel being updated during acceleration.

15. A fuel injection control apparatus as set forth in claim 14, wherein when an acceleration operation state is detected by the acceleration operation state detection means within a predetermined time after the updating of the learned value of the fuel sticking rate, the learned value of the rate of remainder of the sticking fuel is updated.

16. A fuel injection control apparatus as set forth in claim 14, wherein the acceleration operation state detection means detects the acceleration state when the rate of increase of an intake pipe pressure exceeds a predetermined value.

17. A fuel injection control apparatus as set forth in claim 14, wherein the learned value of the rate of remainder of the sticking fuel is changed in accordance with the difference in the time in which the air-fuel ratio is rich and the time in which the air-fuel ratio is lean in a predetermined time after the acceleration operation state is detected by the acceleration detection means within a predetermined time after the updating of the learned value of the fuel sticking rate, i.e., is increased when the difference in time is larger than a first predetermined value and decreased when the difference in time is smaller than a second predetermined value.

18. A fuel injection control apparatus as set forth in claim 13, wherein the correction means corrects the parameters of the fuel dynamic model based on the true value of the fuel sticking rate.

19. A fuel injection control apparatus as set forth in claim 17, wherein the correction means corrects the parameters of the fuel dynamic model based on the learned value of the rate of remainder of sticking fuel.

20. A fuel injection control apparatus as set forth in claim 3, wherein when the amount of fuel sticking to the walls, calculated by the fuel dynamic model, becomes negative, the amount of fuel sticking to the walls is made zero and amount of fuel evaporation from the intake passage and the amount of evaporated fuel in the intake passage are corrected.

21. A fuel injection control apparatus as set forth in claim 13, wherein the control law correction fuel injection means performs at least two injections of control law correction fuel after the fuel sticking to the walls of the intake passage again disappears after calculation of the true value of the fuel sticking rate.

22. A fuel injection control apparatus as set forth in claim 20, wherein when the air-fuel ratio after the previous control law correction fuel injection is rich, the learned value of the rate of remainder of sticking fuel at the time of execution of the previous control law correction fuel injection is decreased and when the air-fuel ratio is lean, the learned value of the rate of remainder of the sticking fuel is increased, thereby determining the learned value of the current rate of remainder of sticking fuel.

23. A fuel injection control apparatus as set forth in claim 21, where the control law correction fuel injection amount is determined by the following equation:

$$TAU = TAU0/(1 - P_{NOW} \cdot R_{CR})$$

where TAU0 is the amount of fuel for making the air-fuel ratio the stoichiometric air-fuel ratio, $P_{NOW}$ is the learned value of the rate of remainder of the fuel sticking to the walls of the intake passage used for the current control law correction fuel injection, and $R_{CR}$ is the true value of the rate of fuel sticking to the walls of the intake passage.

24. A fuel injection control apparatus as set forth in claim 22, wherein the amount of fuel sticking to the walls of the intake passage due to the control law correction fuel injection is determined from the control law correction fuel injection amount, the learned value of the rate of remainder of the fuel sticking to the walls currently, and the true value of the rate of fuel sticking to the walls of the intake passage.

25. A fuel injection control apparatus as set forth in claim 21, wherein when the air-fuel ratio inverts due to execution of two injection of the control law correction fuel, the true value of the rate of remainder of the fuel sticking to the walls is calculated as the arithmetical mean of the learned values of the rate of remainder of fuel sticking to the walls before and after inversion of the air-fuel ratio.

* * * * *

UNITED STATES PATENT AND TRADEMARK OFFICE

CERTIFICATE OF CORRECTION

PATENT NO. : 5,035,225

DATED : July 30, 1991

INVENTOR(S) : Masashi Mizukoshi

It is certified that error appears in the above-identified patent and that said Letters Patent is hereby corrected as shown below:

Column 6, line 8, change "θ" to --B--;

Column 7, line 37, change "of" to --of fuel--;

line 44, change "131 P" to --1-P--;

Column 10, line 41, change "[1 - P O -R
O 1 - Q-S
1 - O1 - Q O]" to

--[1-P O -R
O 1-Q -S
1-O 1-Q -O]--;

UNITED STATES PATENT AND TRADEMARK OFFICE

CERTIFICATE OF CORRECTION

PATENT NO. : 5,035,225

DATED : July 30, 1991

INVENTOR(S) : Masashi Mizukoshi

It is certified that error appears in the above-identified patent and that said Letters Patent is hereby corrected as shown below:

line 68, "fw(k) + R.fv(k)" to
--fw(k)+f2.fv(k)--

Column 11, line 24, change "107" to --w--;

Column 16, line 36, change "correction" to --correction fuel--;

Column 24, line 38, change "$P_R$" to --$P_{CR}$--;

Column 27, line 58, change "stacking" to --sticking--;

line 58, change "fw" to --$f_w^{\wedge}$--;

line 59, change "fv" to --$f_v^{\wedge}$--;

Column 30, line 5, change "fw" to --$f_w^{\wedge}$--;

line 6, change "fv" to --$f_v^{\wedge}$--;

Signed and Sealed this

Twenty-eighth Day of December, 1993

*Attest:*

*Attesting Officer*

BRUCE LEHMAN

*Commissioner of Patents and Trademarks*